US010438596B2

(12) United States Patent
Disch et al.

(10) Patent No.: US 10,438,596 B2
(45) Date of Patent: Oct. 8, 2019

(54) AUDIO ENCODERS, AUDIO DECODERS, SYSTEMS, METHODS AND COMPUTER PROGRAMS USING AN INCREASED TEMPORAL RESOLUTION IN TEMPORAL PROXIMITY OF ONSETS OR OFFSETS OF FRICATIVES OR AFFRICATES

(71) Applicant: Fraunhofer-Gesellschaft zur Foerderung der angewandten Forschung e.V., Munich (DE)

(72) Inventors: Sascha Disch, Fuerth (DE); Christian Helmrich, Erlangen (DE); Markus Multrus, Nuremberg (DE); Markus Schnell, Nuremberg (DE); Arthur Tritthart, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/812,636

(22) Filed: Jul. 29, 2015

(65) Prior Publication Data

US 2015/0332676 A1 Nov. 19, 2015

Related U.S. Application Data

(63) Continuation of application No. PCT/EP2014/051635, filed on Jan. 28, 2014.

(Continued)

(51) Int. Cl.
*G10L 19/025* (2013.01)
*G10L 19/00* (2013.01)
(Continued)

(52) U.S. Cl.
CPC ..... *G10L 19/00* (2013.01); *G10L 21/038* (2013.01); *G10L 19/025* (2013.01); *G10L 19/24* (2013.01)

(58) Field of Classification Search
None
See application file for complete search history.

(56) References Cited

U.S. PATENT DOCUMENTS 6,978,236 B1 * 12/2005 Liljeryd ..... G10L 19/0208 704/200
8,296,159 B2 * 10/2012 Neuendorf ..... G10L 19/0208 704/200

(Continued)

FOREIGN PATENT DOCUMENTS

JP 2010501089 A 1/2010
JP 2010501153 A 1/2010

(Continued)

OTHER PUBLICATIONS

Hiromasa, Fujihara et al., "Three Techniques for Improving Automatic Synchronization Between Music and Lyrics: Fricative Detection, Filler Model, and Novel Feature Vectors for Vocal Activity Detection", National Institute of Advanced Industrial Science and Technology, 2008, pp. 69-72.

(Continued)

*Primary Examiner* — Jialong He
(74) *Attorney, Agent, or Firm* — Perkins Coie LLP; Michael A. Glenn

(57) ABSTRACT

An audio encoder for providing an encoded audio information on the basis of an input audio information has a bandwidth extension information provider configured to provide bandwidth extension information using a variable temporal resolution and a detector configured to detect an onset of a fricative or affricate. The audio encoder is configured to adjust a temporal resolution used by the (Continued)

bandwidth extension information provider such that bandwidth extension information is provided with an increased temporal resolution at least for a predetermined period of time before a time at which an onset of a fricative or affricate is detected and for a predetermined period of time following the time at which the onset of the fricative or affricate is detected. Alternatively or in addition, the bandwidth extension information is provided with an increased temporal resolution in response to a detection of an offset of a fricative or affricate. Audio encoders and methods use a corresponding concept.

16 Claims, 13 Drawing Sheets

Related U.S. Application Data

(60) Provisional application No. 61/758,078, filed on Jan. 29, 2013.

(51) Int. Cl.
*G10L 21/038* (2013.01)
*G10L 19/24* (2013.01)

(56) References Cited

U.S. PATENT DOCUMENTS

| | | | | |
|---|---|---|---|---|
| 8,788,276 | B2 * | 7/2014 | Neuendorf | G10L 21/038 704/500 |
| 2001/0023396 | A1 * | 9/2001 | Gersho | G10L 19/10 704/220 |
| 2007/0124141 | A1 | 5/2007 | You et al. | |
| 2008/0059202 | A1 | 3/2008 | You et al. | |
| 2010/0114583 | A1 * | 5/2010 | Lee | G10L 19/025 704/500 |
| 2011/0099018 | A1 * | 4/2011 | Neuendorf | G10L 21/038 704/500 |
| 2011/0194598 | A1 | 8/2011 | Miao et al. | |
| 2011/0238425 | A1 * | 9/2011 | Neuendorf | G10L 19/008 704/500 |
| 2013/0182862 | A1 * | 7/2013 | Disch | G10H 1/08 381/61 |
| 2014/0257824 | A1 * | 9/2014 | Taleb | G10L 19/20 704/500 |

FOREIGN PATENT DOCUMENTS

| | | | |
|---|---|---|---|
| JP | 2011501225 | A | 1/2011 |
| KR | 1020090076894 | A | 7/2009 |
| RU | 2011101617 | A | 7/2012 |
| WO | 0045378 | A2 | 8/2000 |
| WO | 2010003543 | A1 | 1/2010 |
| WO | 2010003544 | A1 | 1/2010 |
| WO | 2010036061 | A2 | 4/2010 |
| WO | 2010047886 | A2 | 4/2010 |
| WO | 2011047886 | A1 | 4/2011 |

OTHER PUBLICATIONS

Ruinskiy, Dima et al., "Spectral and Textural Feature-Based System for Automatic Detection of Fricatives and Affricates", 2010 IEEE 26th Convention of Electrical and Electronics Engineers in Israel, 2010, 000771-000775.

"Information technology—MPEG audio technologies—Part 3: Unified speech and audio coding", ISO/IEC FDIS 23003-3:2011(E), Sep. 20, 2011, 291 pages.

* cited by examiner

Spectrogram of the original speech signal with conventional BWE framing (magenta dashed vertical lines) and detected fricative borders (black dashed vertical lines).

Spectrogram of the original speech signal with inventive BWE framing (black solid vertical lines).

Spectrogram of coded speech signal with conventional: BWE framing (yellow ellipses indicate typical artefacts cause by the conventional BWE framing).

Spectrogram of coded speech signal with inventive BWE framing (for comparison with FIGURE 4). The problematic areas as indicated in FIGURE 4 are substantially improved.

AUDIO ENCODERS, AUDIO DECODERS, SYSTEMS, METHODS AND COMPUTER PROGRAMS USING AN INCREASED TEMPORAL RESOLUTION IN TEMPORAL PROXIMITY OF ONSETS OR OFFSETS OF FRICATIVES OR AFFRICATES

CROSS-REFERENCE TO RELATED APPLICATIONS

This application is a continuation of copending International Application No. PCT/EP2014/051635, filed Jan. 28, 2014, which is incorporated herein by reference in its entirety, and additionally claims priority from U.S. Provisional Application No. 61/758,078, filed Jan. 29, 2013, which is also incorporated herein by reference in its entirety.

TECHNICAL FIELD

Embodiments according to the invention are related to an audio encoder for providing an encoded audio information on the basis of an input audio information.

Further embodiments according to the invention are related to an audio decoder for providing a decoded audio information on the basis of an encoded audio information.

Further embodiments according to the invention are related to a system comprising an audio encoder and an audio decoder.

Further embodiments according to the invention are related to a method for providing encoded audio information on the basis of an input audio information.

Further embodiments according to the invention are related to a method for providing a decoded audio information on the basis of an encoded audio information.

Further embodiments according to the invention are related to a computer program for performing one of said methods.

Further embodiments according to the invention are related to an onset and offset modeling of fricatives or affricates in audio bandwidth extension for speech.

BACKGROUND OF THE INVENTION

In the recent years, there is an increasing demand for digital storage and transmission of audio signals, and, in particular, speech signals. In some cases, like, for example, in mobile communication applications, it is desirable to obtain a comparatively low bitrate.

However, in order to obtain a good compromise between bitrate and audio quality (or speech quality), there are approaches to encode a low frequency portion of an audio signal (for example, a frequency portion up to approximately 6 kHz) using a comparatively high precision, and to rely on a bandwidth extension to reconstruct a high frequency portion of the audio content (for example, above approximately 6 or 7 kHz). For example, the bandwidth extension may be based on a reconstruction of the high frequency portion of the audio content using a comparatively small number of parameters, wherein the parameters may, for example, describe a spectral envelope in a coarse manner.

A well-known implementation of the bandwidth extension is spectral bandwidth replication (SBR), which has been standardized within the MPEG (moving pictures expert group).

For example, some details regarding the spectral bandwidth replication are described in sections 4.6.18 and 4.6.19 of the International Standard ISO/IEC 14496-3:200X(E), subpart 4.

Moreover, reference is also made to US 2011/0099018 A1, which describes an apparatus and a method for calculating bandwidth extension data using a spectral tilt controlled framing. Said patent application describes an apparatus for calculating bandwidth extension data of an audio signal in a bandwidth extension system, in which a first spectral band is encoded with a first number of bits and a second spectral band different from the first spectral band is encoded with a second number of bits, the second number of bits being smaller than the first number of bits. The apparatus has a controllable bandwidth extension parameter calculator for calculating bandwidth extension parameters for the second frequency band in a frame-wise manner for a first sequence of frames of the audio signal. Each frame has a controllable start time instant. The apparatus additionally includes a spectral tilt detector for detecting a spectral tilt in a time portion of the audio signal and for signaling a start time instant for the individual frames of the audio signal depending on a spectral tilt.

However, it has been found that many of the conventional approaches for bandwidth extension substantially degrade an auditory impression which is obtained in the presence of fricatives or affricates. For example, pre-echoes and post-echoes may be caused by conventional bandwidth extension techniques. Moreover, fricatives or affricates may sound too sharp when using conventional bandwidth extension techniques.

In view of this situation, there is a desire to create a concept for a bandwidth extension which allows for an improved audio quality.

SUMMARY OF THE INVENTION

According to an embodiment, an audio encoder for providing an encoded audio information on the basis of an input audio information may have: a bandwidth extension information provider configured to provide bandwidth extension information using a variable temporal resolution; and a detector configured to detect an onset of a fricative or affricate; wherein the audio encoder is configured to adjust a temporal resolution used by the bandwidth extension information provider such that bandwidth extension information is provided with an increased temporal resolution at least for a predetermined period of time before a time at which an onset of a fricative or affricate is detected and for a predetermined period of time following the time at which the onset of the fricative or affricate is detected; wherein the bandwidth extension information provider is configured to provide the bandwidth extension information such that the bandwidth extension information is associated with temporally regular time intervals of equal temporal lengths, wherein the bandwidth extension information provider is configured to provide a single set of bandwidth extension information for a time interval of a given temporal length if a first temporal resolution is used, and wherein the bandwidth extension information provider is configured to provide a plurality of sets of bandwidth extension information associated with time sub-intervals for a time interval of the given temporal length if a second temporal resolution is used; wherein the audio encoder is configured to adjust a temporal resolution used by the bandwidth extension information provider such that at least one time sub-interval, to which a set of bandwidth extension information is associated, immediately precedes another time sub-interval, to which another set of bandwidth extension information is associated and during which another time sub-interval an onset of a fricative or affricate is detected, such that the increased temporal resolution is used in at least one time sub-interval preceding the time sub-interval in which an onset of a fricative or affricate is detected.

According to another embodiment, an audio encoder for providing an encoded audio information on the basis of an input audio information may have: a bandwidth extension information provider configured to provide bandwidth extension information using a variable temporal resolution; and a detector configured to detect an offset of a fricative or affricate; wherein the audio encoder is configured to adjust a temporal resolution used by the bandwidth extension information provider such that bandwidth extension information is provided with an increased temporal resolution in response to a detection of an offset of a fricative or affricate.

Another embodiment may have an audio decoder for providing a decoded audio information on the basis of an encoded audio information, wherein the audio decoder is configured to perform a bandwidth extension on the basis of a bandwidth extension information provided by an audio encoder, such that the bandwidth extension is performed with an increased temporal resolution at least for a predetermined period of time before a time at which an offset of a fricative or affricate is detected and for a predetermined period of time following the time at which the offset of the fricative or affricate is detected.

According to another embodiment, a system may have: an audio encoder as mentioned above; and an audio decoder configured to receive the encoded audio information provided by the audio encoder, and to provide, on the basis thereof, a decoded audio information, wherein the audio decoder is configured to perform a bandwidth extension on the basis of the bandwidth extension information provided by the audio encoder, such that the bandwidth extension is performed with an increased temporal resolution at least for a predetermined period of time before a time at which an onset of a fricative or affricate is detected and for a predetermined period of time following the time at which the onset of the fricative or affricate is detected, or such that the bandwidth extension is performed with an increased temporal resolution at least for a predetermined period of time before a time at which an offset of a fricative or affricate is detected and for a predetermined period of time following the time at which the offset of the fricative or affricate is detected.

According to still another embodiment, a method for providing an encoded audio information on the basis of an input audio information may have the steps of: providing bandwidth extension information using a variable temporal resolution; and detecting an onset of a fricative or affricate; wherein a temporal resolution used for providing the bandwidth extension information is adjusted such that bandwidth extension information is provided with an increased temporal resolution at least for a predetermined period of time before a time at which an onset of a fricative or affricate is detected and for a predetermined period of time following the time at which the onset of the fricative or affricate is detected; wherein the bandwidth extension information is provided such that the bandwidth extension information is associated with temporally regular time intervals of equal temporal lengths, wherein a single set of bandwidth extension information is provided for a time interval of a given temporal length if a first temporal resolution is used, and wherein a plurality of sets of bandwidth extension information associated with time sub-intervals is provided for a time interval of the given temporal length if a second temporal resolution is used; wherein a temporal resolution used is adjusted such that at least one time sub-interval, to which a set of bandwidth extension information is associated, immediately precedes another time sub-interval, to which another set of bandwidth extension information is associated and during which another time sub-interval an onset of a fricative or affricate is detected, such that the increased temporal resolution is used in at least one time sub-interval preceding the time sub-interval in which an onset of a fricative or affricate is detected.

According to another embodiment, a method for providing an encoded audio information on the basis of an input audio information may have the steps of: providing bandwidth extension information using a variable temporal resolution; and detecting an offset of a fricative or affricate; wherein a temporal resolution used for providing the bandwidth extension information is adjusted such that bandwidth extension information is provided with an increased temporal resolution in response to a detection of an offset of a fricative or affricate.

Another embodiment may have a method for providing a decoded audio information on the basis of an encoded audio information, wherein the method has performing a bandwidth extension on the basis of a bandwidth extension information provided by an audio encoder, such that the bandwidth extension is performed with an increased temporal resolution at least for a predetermined period of time before a time at which an offset of a fricative or affricate is detected and for a predetermined period of time following the time at which the offset of the fricative or affricate is detected.

Another embodiment may have a computer program for performing a method as mentioned above when the computer program runs on a computer.

An embodiment according to the invention creates an audio encoder for providing an encoded audio information on the basis of an input audio information. The audio encoder comprises a bandwidth extension information provider configured to provide bandwidth extension information using a variable temporal resolution. The audio encoder also comprises a detector configured to detect an onset of a fricative or affricate. The audio encoder is configured to adjust a temporal resolution used by the bandwidth extension information provider such that bandwidth extension information is provided with an increased temporal resolution at least for a predetermined period of time before a time at which an onset of a fricative or affricate is detected and for a predetermined period of time following the time at which the onset of the fricative or affricate is detected.

This embodiment according to the invention is based on the finding that a good auditory quality can be achieved if bandwidth extension information is provided with high temporal resolution for an entire environment of a time at which an onset of the fricative or affricate is detected. Accordingly, a whole onset of a fricative or affricate, which typically comprises a certain temporal extension before a time at which the onset of the fricative or affricate is detected and a certain period (temporal extension) after the time at which the onset of the fricative or affricate is actually detected, is encoded with high temporal resolution (at least with respect to the bandwidth extension information), which helps to avoid pre-echoes and which also helps to avoid an unnatural hearing impression. Typically, the onset of the fricative or affricate cannot be detected very precisely, since the detection of the onset of the fricative or affricate is often based on a detection of a threshold crossing, which naturally does not appear at the very beginning of the onset of the fricative or affricate. Accordingly, the time at which the onset of the fricative or affricate is (actually) detected is temporally after the very beginning (or onset) of the fricative or affricate. Accordingly, by ensuring that the bandwidth extension information is provided with an increased temporal resolution (when compared to a "normal" temporal resolution) at least for a predetermined period of time before the time at which the onset of the fricative or affricate is (actually) detected, it can be reached that the details at the very beginning of the onset of the fricative or affricate can also be reproduced with good resolution, wherein it has been found that even such details at the very beginning of the onset of the fricative or affricate are important for a good hearing impression. Thus, by providing bandwidth extension information with an increased temporal resolution at least for a predetermined period of time before the time at which the onset of the fricative or affricate is detected does not only help to avoid pre-echoes but also allows to reproduce details of the onset of the fricative or affricate. Similarly, by ensuring that the bandwidth extension information is provided with an increased temporal resolution for a predetermined period of time following the time at which the onset of the fricative or affricate is detected allows to reproduce details of the onset of the fricative or affricate which are important for the hearing impression.

Accordingly, the concept described herein allows to reproduce an entire onset of a fricative or affricate with a high temporal resolution, which helps to avoid a degradation of a hearing impression, which would be caused, for example, by a too coarse temporal resolution (of the bandwidth extension information) at a very beginning of the onset of the fricative or affricate or at a transition from the onset of the fricative or affricate to a stationary signal part.

In an embodiment, the audio encoder is configured to switch from a first temporal resolution for the provision of the bandwidth extension information to a second temporal resolution for the provision of the bandwidth extension information in response to the detection of the onset of the fricative or affricate, wherein the second temporal resolution is higher than the first temporal resolution. Accordingly, a switching between two different temporal resolutions for the provision of the bandwidth extension information is performed, wherein said switching is controlled by the detection of the onset of the fricative or affricate. Accordingly, a simple controlling scheme is created, which can easily be implemented in an audio encoder or an audio decoder.

In an embodiment, the bandwidth extension information provider is configured to provide the bandwidth extension information such that the bandwidth extension information is associated with temporally regular time intervals of equal temporal length (which may form a fundamental—but subdividable—time grid for the provision of the bandwidth extension information). The bandwidth extension information provider is configured to provide a single set of bandwidth extension information for a time interval of a given temporal length when a first temporal resolution (for example, a comparatively low temporal resolution) is used. Moreover, the bandwidth extension information provider may be configured to provide a plurality of sets of bandwidth extension information associated with time sub-intervals for a time interval of the given temporal length when a second temporal resolution (for example, a comparatively higher temporal resolution) is used.

By using temporally regular time intervals of equal temporal length (for example, frames) as a (fundamental) time grid for the provision of the bandwidth extension information, an audio encoder can be implemented easily. For example, the bandwidth extension information provider only needs to be switched between two discrete temporal resolutions, which can be implemented without excessive effort. For example, the bandwidth extension information provider may merely need to be implemented to provide a single set of bandwidth extension information on the basis of a time interval of the given temporal length, and to provide multiple sets of bandwidth extension information on the basis of a predetermined (and fixed) number of (equal length) sub-intervals of the time interval of the given temporal length. Accordingly, it may, for example, be sufficient that the bandwidth extension information provider is configured to alternatively provide either a single set of bandwidth extension information on the basis of a time interval of the given temporal length or to provide four sets of bandwidth extension information on the basis of four time sub-intervals, each of the time sub-intervals having a length which is equal to a quarter of the given temporal length. Moreover, by using such a concept, a signaling effort, which may be necessitated for signaling for which time intervals the bandwidth extension information is provided, may be kept small, since there is only the choice between "coarse resolution" (for example, a single set of bandwidth extension information for a time interval of the given temporal length) and "fine resolution" (for example, n sets of bandwidth extension information associated with n time sub-intervals of equal length). Thus, a particularly efficient concept for the provision of the bandwidth extension information is provided.

In an embodiment, the audio encoder is configured to adjust a temporal resolution used by the bandwidth extension information provider such that at least one time sub-interval, to which a set of bandwidth extension information is associated, immediately precedes another time sub-interval, to which another set of bandwidth extension information is associated and during which another time sub-interval the onset of a fricative or affricate is detected, such that the increased temporal resolution is used in at least one time sub-interval preceding the time sub-interval in which the onset of a fricative or affricate is detected. Accordingly, it is possible to provide the bandwidth extension information with a high temporal resolution even at the very beginning of the onset of the fricative or affricate, i.e., even before the onset of the fricative or affricate is actually detectable.

In an embodiment, the audio encoder is configured to subdivide a given time interval of the given temporal length into four time sub-intervals of equal length, if an increased temporal resolution is used to provide bandwidth extension information for the given time interval of the given temporal length, such that four sets of bandwidth extension information (for example, four sets of bandwidth extension parameters, each of which is associated with one of the time sub-intervals) are provided for the given time interval of the given temporal length. Accordingly, a high temporal resolution of the bandwidth extension information can be achieved, since the four sets of bandwidth extension information may, for example, separately describe envelopes of a high frequency signal portion of the audio content for the four sub-intervals. Thus, differences of the spectral envelopes of the high frequency signal portion of the four time sub-intervals can be considered since each of the sets of bandwidth extension information may represent the frequency envelope (or spectral envelope) of the high frequency portion of one of the time sub-intervals.

In an embodiment, the audio encoder is configured to selectively use an increased temporal resolution to provide bandwidth extension information for a first time interval of a given temporal length preceding a second time interval of the given temporal length, if an onset of a fricative or affricate is detected within the second time interval and if a temporal distance between a time at which the onset of the fricative or affricate is detected and a border between the first time interval and the second time interval is smaller than a predetermined temporal distance. Accordingly, the bandwidth extension information of a first time interval (for example, a first frame) is provided with increased temporal resolution (when compared to a "normal" temporal resolution) even if the time at which the onset of the fricative or affricate is detected lies within a subsequent second time interval (for example, a subsequent second frame), if it is assumed that the very beginning of the onset of the fricative or affricate (which typically lies before the time at which the onset of the fricative or affricate is actually detected) lies within the first time interval. Accordingly, the entire onset of the fricative or affricate, including the very beginning of the onset of the fricative or affricate and possibly even a certain amount of time before the onset of the fricative or affricate, it is evaluated with high temporal resolution when providing the bandwidth extension information, which brings along a good speech reproduction. Rather than merely avoiding pre-echoes, the onset of the fricative or affricate can be reproduced precisely, without an excessive sharpness or other substantial artifacts.

In an embodiment, the audio encoder is configured to perform a temporal look-ahead, such that an increased temporal resolution is used to provide bandwidth extension information for a first time interval of a given temporal length preceding a second time interval of the given temporal length in response to a detection of an onset of a fricative or affricate in the second time interval. Accordingly, it is possible to provide the bandwidth extension information with increased temporal resolution for an entire onset of the fricative or affricate (and possibly even for a short period of time before the onset of the fricative or affricate), which contributes to an improved audio quality.

In an embodiment, the audio encoder is configured to adjust a temporal resolution used by the bandwidth extension information provider such that bandwidth extension information is provided with a same increased temporal resolution at least for a predetermined period of time before a time at which an onset of a fricative or affricate is detected and for a predetermined period of time following the time at which the onset of the fricative or affricate is detected. By using equal temporal resolution, the provision of the bandwidth extension information is simplified when compared to cases in which different temporal resolutions are used before and after the time at which the onset of the fricative or affricate is detected. Moreover, a signaling effort is reduced by using a same increased temporal resolution for the predetermined period of time before a time at which the onset of a fricative or affricate is detected and for a predetermined period of time following the time at which the onset of the fricative or affricate is detected.

In an embodiment, the audio encoder is configured to adjust a temporal resolution used by the bandwidth extension information provider such that sets of bandwidth extension information are provided with same increased temporal resolutions at least for a first time sub-interval, a second time sub-interval and a third time sub-interval, wherein the first time sub-interval immediately precedes the second time sub-interval, wherein an onset of a fricative or affricate is detected in the second time sub-interval, and wherein the third time sub-interval immediately follows the second time sub-interval. Accordingly, the first time sub-interval and the third time sub-interval, which "embed" the second time sub-interval during which the onset of the fricative or affricate is detected, are processed with a same temporal resolution when providing the sets of bandwidth extension information. Accordingly, a substantial part of an onset of a fricative or affricate, or even an entire onset of a fricative or affricate, is handled with a high temporal resolution when providing the bandwidth extension information. Moreover, by using the same (increased, or "high" temporal resolution for the first time sub-interval, the second time sub-interval and the third time sub-interval, the encoding and decoding is simple and a signaling overhead (for signaling a temporal resolution) is small.

In an embodiment, the detector is configured to detect an offset of a fricative or affricate. In this case, the audio encoder is configured to adjust a temporal resolution used by the bandwidth extension information provider such that bandwidth extension information is provided with an increased temporal resolution at least for a predetermined period of time before a time at which an offset of a fricative or affricate is detected and for a predetermined period of time following the time at which the offset of the fricative or affricate is detected. This embodiment according to the invention is based on the finding that the bandwidth extension should also be performed with high temporal resolution for an offset of a fricative or affricate. It has been found that the human hearing is actually also sensitive to the offsets of fricatives or affricates, such that it is worth the bitrate overhead to encode the offset of the fricative or affricate with high temporal resolution (with respect to the bandwidth extension information). Moreover, it has been found that a provision of bandwidth extension information with low temporal resolution during an offset of a fricative or affricate typically results in an inappropriately sharp hearing impression of the offset of the fricative or affricate, which is perceived as an artifact.

Moreover, it should be noted that any of the concepts mentioned before with respect to the adjustment of the temporal resolution used by the bandwidth extension information provider in response to an onset of a fricative or affricate can also be applied advantageously in response to a detection of an offset of a fricative or affricate. In other words, the concept described above can be applied in an analogous manner, wherein the "onset of a fricative or affricate" is replaced by the "offset of a fricative or affricate".

In an embodiment, the detector is configured to evaluate a zero crossing rate, and/or an energy ratio and/or a spectral tilt in order to detect an onset of a fricative or affricate. It has been found that the evaluation of one or more of the above-mentioned quantities (zero crossing rate, energy ratio, spectral tilt) allows for a reasonably accurate detection of the onset of a fricative or affricate. For example, one or more of the above-mentioned values, or a value derived from a combination of the above-mentioned quantities, can be compared to a threshold value to detect the presence of a fricative or affricate.

In an embodiment the encoder is configured to selectively adjust a temporal resolution used by the bandwidth extension information provider such that bandwidth extension information is provided with an increased temporal resolution in response to a detection of an onset of a fricative or affricate only for a speech signal portion but not for a music signal portion. This concept is based on the finding that fricatives or affricates are more important for the perception of speech than for the perception of music signal portions.

Accordingly, a bitrate overhead, which may be caused by the usage of an increased temporal resolution for the provision of bandwidth extension information can be avoided for music signal portions, which helps to reduce an overall bitrate, or which helps to focus on an encoding of perceptually more important features for music signal portions.

In an embodiment, the audio encoder is configured to selectively use an increased temporal resolution to provide bandwidth extension information for a plurality of subsequent time intervals that fully encompass an onset of a detected fricative or affricate. Accordingly, the onset of a fricative or affricate is encoded with high precision even when using a bandwidth extension, such that the usage of the bandwidth extension does not substantially degrade a hearing impression.

Another embodiment according to the invention creates an audio encoder for providing an encoded audio information on the basis of an input audio information. The audio encoder comprises a bandwidth extension information provider configured to provide bandwidth extension information using a variable temporal resolution. The audio encoder also comprises a detector configured to detect an offset of a fricative or affricate. The audio encoder is configured to adjust a temporal resolution used by the bandwidth extension information provider such that bandwidth extension information is provided with an increased temporal resolution in response to a detection of an offset of a fricative or affricate.

This embodiment according to the invention is based on the finding that offsets of fricatives or affricates are also important for a perception of an audio content and should therefore be encoded with high temporal resolution. In particular, this embodiment according to the invention is based on the finding that an offset of a fricative or affricate is typically perceived as "too sharp" if the offset of the fricative or affricate is encoded with insufficient temporal resolution of a bandwidth extension information. Thus, by increasing a temporal resolution used by a bandwidth extension information provider, an audio quality, for example of speech signals, can be substantially improved.

In an embodiment, the audio encoder is configured to adjust a temporal resolution used by the bandwidth extension information provider such that a bandwidth extension information is provided with an increased temporal resolution at least for a predetermined period of time before a time at which an offset of a fricative or affricate is detected and for a predetermined period of time following the time at which the offset of the fricative or affricate is detected. Accordingly, it is possible to encode an entire offset of a fricative or affricate with increased temporal resolution, even though a detector is typically only able to detect a center of an offset of a fricative or affricate, or the like.

Another embodiment according to the invention creates an audio decoder for providing a decoded audio information on the basis of an encoded audio information. The audio decoder is configured to perform a bandwidth extension on the basis of a bandwidth extension information provided by an audio encoder, such that the bandwidth extension is performed with an increased temporal resolution at least for a predetermined period of time before a time at which an onset of a fricative or affricate is detected and for a predetermined period of time following the time at which the onset of the fricative or affricate is detected. Accordingly, the audio decoder is capable to reproduce a substantial portion of an onset of a fricative or affricate, or even an entire onset of a fricative or affricate, with high temporal resolution. Accordingly, the bandwidth extension, which is performed by the audio decoder, can be well-adapted to the presence of the fricative or affricate, such that the changes of the spectral envelope of the high-frequency portion of the audio content, which occur during the onset of the fricative or affricate, can be reproduced with good perceptual quality. Accordingly, a good hearing impression is achieved.

In an embodiment, the audio decoder may comprise a detector which is configured to detect an onset of a fricative or affricate on the basis of a decoded audio information, which represents a low frequency portion of an audio content and by itself decide about an adjustment of the temporal resolution used for the bandwidth extension. Any of the criteria for detecting an onset of a fricative or affricate discussed herein with respect to an audio encoder may also be applied in the audio decoder (provided the necessitated information is available at the side of the audio decoder).

Alternatively, however, the audio decoder may be configured to adjust the temporal resolution used for the bandwidth extension on the basis of a side information of the encoded audio information.

Another embodiment according to the invention creates an audio decoder for providing a decoded audio information on the basis of an encoded audio information. The audio decoder is configured to perform a bandwidth extension on the basis of a bandwidth extension information provided by an audio encoder, such that the bandwidth extension is performed with an increased temporal resolution at least for a predetermined period of time before a time at which an offset of a fricative or affricate is detected and for a predetermined period of time following the time at which the offset of the fricative or affricate is detected.

This embodiment according to the invention is based on the idea that a good audio quality can be achieved by performing a bandwidth extension with an increased temporal resolution during an offset of a fricative or affricate. Moreover, the embodiment is based on the idea that the offset of the fricative or affricate typically extends over a certain period of time, wherein the time at which the offset of the fricative or affricate is detected typically lies within said certain period of time.

Another embodiment according to the invention creates a system comprising an audio encoder, as described above, and an audio decoder configured to receive the encoded audio information provided by the audio encoder, and to provide, on the basis thereof, a decoded audio information. The audio decoder is configured to perform a bandwidth extension on the basis of the bandwidth extension information provided by the audio encoder, such that the bandwidth extension is performed with an increased temporal resolution at least for a predetermined period of time before a time at which an onset of a fricative or affricate is detected and for a predetermined period of time following the time at which the onset of the fricative or affricate is detected, and/or such that the bandwidth extension is performed with an increased temporal resolution at least for a predetermined period of time before a time at which an offset of a fricative or affricate is detected and for a predetermined period of time following the time at which the offset of the fricative or affricate is detected.

The system allows for an encoding and decoding of an audio content, wherein a comparatively low bitrate is achieved by using a bandwidth extension, and wherein a good reproduction of fricatives or affricates is ensured by using an increased temporal resolution in an environment of an onset of a fricative or affricate and/or in an environment of an offset of a fricative or affricate.

Another embodiment according to the invention creates a method for providing an encoded audio information on the basis of an input audio information. The method comprises providing bandwidth extension information using a variable temporal resolution and detecting an onset of a fricative or affricate. The temporal resolution used for providing the bandwidth extension information is adjusted such that bandwidth extension information is provided with an increased temporal resolution at least for a predetermined period of time before a time at which an onset of a fricative or affricate is detected and for a predetermined period of time following the time at which the onset of the fricative or affricate is detected. This method is based on the same considerations as the above-described audio encoder.

Another embodiment according to the invention creates a method for providing an encoded audio information on the basis of an input audio information. The method comprises providing bandwidth extension information using a variable temporal resolution and detecting an offset of a fricative or affricate. The temporal resolution used for providing the bandwidth extension information is adjusted such that bandwidth extension information is provided with an increased temporal resolution in response to a detection of an offset of a fricative or affricate. This method is based on the same considerations as the above-described audio encoder.

Another embodiment according to the invention creates a method for providing a decoded audio information on the basis of an encoded audio information. The method comprises performing a bandwidth extension on the basis of a bandwidth extension information provided by an audio encoder, such that the bandwidth extension is performed with an increased temporal resolution at least for a predetermined period of time before a time at which an onset of a fricative or affricate is detected and for a predetermined period of time following the time at which the onset of the fricative or affricate is detected. This method is based on the same considerations as the above described audio decoder.

Another embodiment according to the invention creates a method for providing a decoded audio information on the basis of an encoded audio information. The method comprises performing a bandwidth extension on the basis of a bandwidth extension information provided by an audio encoder, such that the bandwidth extension is performed with an increased temporal resolution at least for a predetermined period of time before a time at which an offset of a fricative or affricate is detected and for a predetermined period of time following the time at which the offset of the fricative or affricate is detected. This method is based on the same considerations as the above-described audio decoder.

Another embodiment according to the invention creates a computer program for performing one of the above described methods.

An embodiment according to the invention creates an encoded audio signal comprising an encoded representation of a low frequency portion of an audio content and a plurality of sets of bandwidth extension parameters. The bandwidth extension parameters are provided with an increased temporal resolution at least for a predetermined period of time before a time at which an onset of a fricative or affricate is present in the audio content and for a predetermined period of time following the time at which the onset of the fricative or affricate is present in the audio content.

Another embodiment according to the invention creates an encoded audio signal comprising an encoded representation of a low frequency portion of an audio content and a plurality of sets of bandwidth extension parameters. The bandwidth extension parameters are provided with an increased temporal resolution at least for a portion of the audio content in which an offset of a fricative or affricate is present.

These encoded audio signals are based on the same considerations as the above described audio encoder and the above described audio decoder.

BRIEF DESCRIPTION OF THE DRAWINGS

Embodiments according to the present invention will subsequently be described taking reference to the enclosed figures in which.

DETAILED DESCRIPTION OF THE INVENTION

1. Audio Encoder According to FIG. 1

Figure 1:
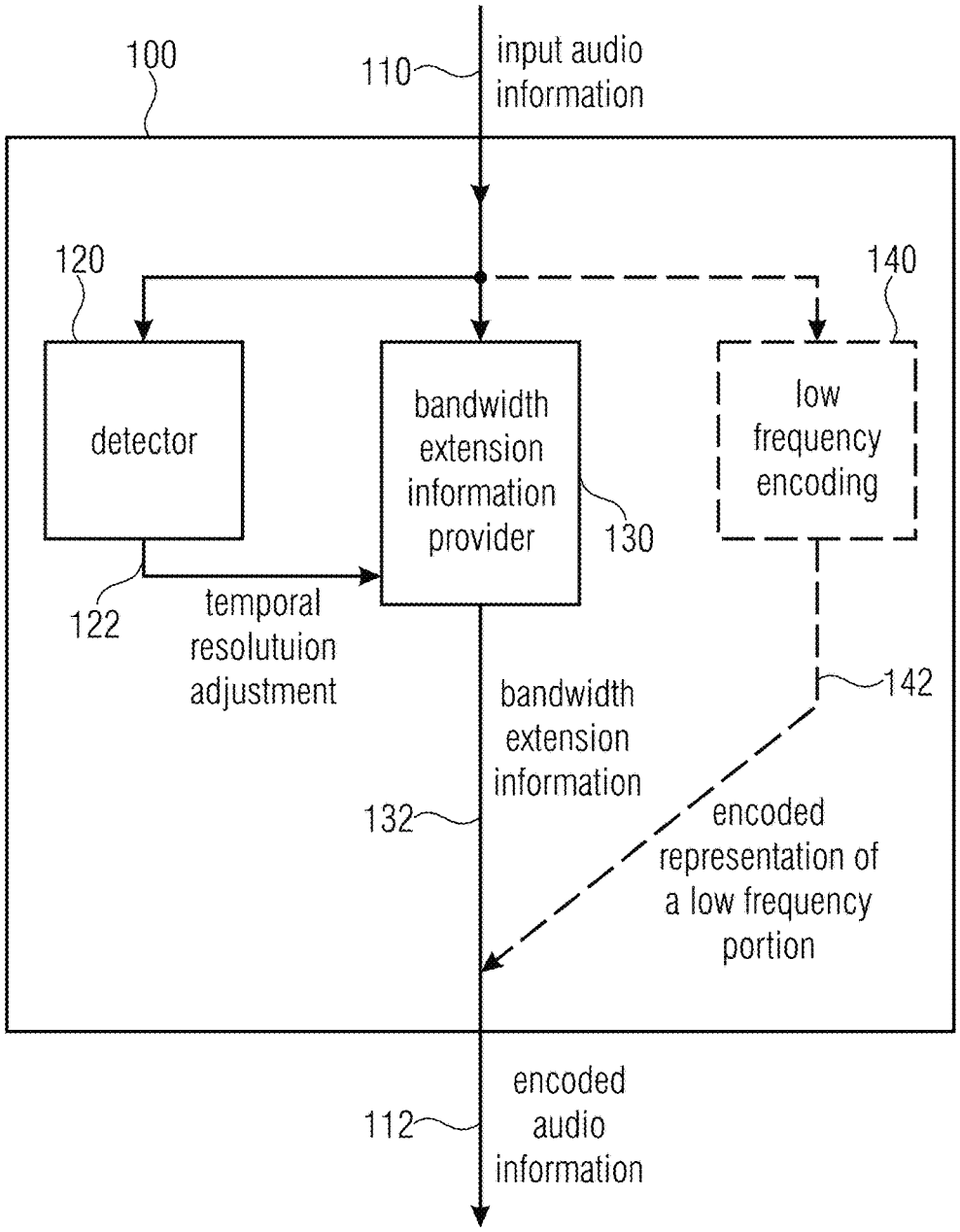
FIG. 1 shows a block schematic diagram of an audio encoder, according to an embodiment of the present invention.

FIG. 1 shows a block schematic diagram of an audio encoder according to an embodiment of the invention.

The audio encoder 100 is configured to receive an input audio information 110 and provide, on the basis thereof an encoded audio information 112.

The audio encoder 100 comprises a detector 120, which may, for example, receive the input audio information 110. The detector 120 is configured to detect an onset of a fricative or affricate, for example, on the basis of the input audio information 110. The detector 120 may provide a temporal resolution adjustment information 122.

The audio encoder 100 also comprises a bandwidth extension information provider 130, which is configured to provide a bandwidth extension information 132 using a variable temporal resolution. For example, the bandwidth extension information provider 130 may be configured to receive the input audio information (and possibly additional preprocessed audio information). Moreover, the bandwidth extension information provider 130 may also be configured to receive the temporal resolution adjustment information 122 from the detector 120.

The audio encoder 100 may further comprise a low frequency encoding 140, which may, for example, encode a low frequency portion of an audio content represented by the input audio information 110, to thereby provide an encoded representation 142 of a low frequency portion of the audio content represented by the input audio information 110. Accordingly, the encoded audio information 112 may comprise the bandwidth extension information 132 and the encoded representation 142 of the low frequency portion of the audio content. However, details regarding the low frequency encoding are not essential for the present invention.

In the following, the functionality of the audio encoder 100 will be described in more detail.

The low frequency encoding 140 may encode a low frequency portion of the audio content represented by the input audio information 110. For example, a portion of the audio content having frequencies below approximately 6 kHz or below approximately 7 kHz (or below any other predetermined frequency limit) may be encoded using the low frequency encoding 140. The low frequency encoding 140 may, for example, use any of the well-known audio encoding techniques, like transform-domain encoding or linear-prediction-domain encoding. In other words, the low frequency encoding 140 may, for example, use an audio encoding concept which may be based on the well-known "advanced audio coding" (AAC) or which may be based on the well-know "linear-prediction coding". For example, the low frequency encoding 140 may comprise (or use) a modified "advanced audio coding" as described in the International Standard ISO/IEC 23003-3. Alternatively, or in addition, the low frequency encoding 140 may comprise (or use) a linear-prediction coding as described, for example, in the International Standard ISO/IEC 23003-3. However, the low frequency encoding 140 may also comprise a switching between a (modified or unmodified) "advanced audio coding" and a linear-prediction domain audio coding. However, it should be noted that, in principle, any concepts known for the encoding of an audio signal may be used in the low frequency encoding 140, to provide the encoded representation 142 of the low frequency portion of the audio content represented by the input audio information.

However, the bandwidth extension information provider 130 may provide bandwidth extension information (for example, in the form of bandwidth extension parameters), which allows to reconstruct a high frequency portion of the audio content represented by the input audio information 110, which high frequency portion is not represented by the encoded representation 142 provided by the low frequency encoding 140. For example, the bandwidth extension information provider 130 may be configured to provide some or all of the spectral band replication parameters which are described in the International Standard ISO/IEC 14496-3 (or any other standards referring to ISO/IEC 14496-3).

For example, the bandwidth extension information provider may be configured to provide some or all of the parameters described in a section "SBR tool" and/or "low delay SBR" of the International Standard ISO/IEC 14496-3. For example, the bandwidth extension information provider 130 may be configured to provide some or all of the parameters of the syntax element "sbr_extension_data( )", "sbr_header( )", "sbr_data( )", "sbr_single_channel_element( )", "sbr_channel_pair_element( )" or any of the other bitstream elements referenced therein, as defined, for example, in the International Standard ISO/IEC 14496-3. In other words, the bandwidth extension information provider 130 may provide spectral bandwidth replication parameters, which may, for example, coarsely describe a spectral envelope of a high frequency portion of the audio content represented by the input audio information 110. However, the bandwidth extension information provider 130 may further comprise parameters describing a noise in a high frequency portion of the audio content represented by the input audio information 110, and/or may comprise parameters describing one or more sinusoidal signals included in the high frequency portion of the audio content represented by the input audio information 110. In addition, the bandwidth extension information provider 130 may, for example, provide a number of configuration parameters, as also described in the International Standard ISO/IEC 14496-3 with respect to the spectral bandwidth replication tool. For example, the bandwidth extension information provider 130 may provide one or more parameters representing a temporal resolution which is used for the provision of sets of bandwidth extension information, for example a temporal resolution using which updated sets of parameters representing a spectral envelope of the high frequency portion of the audio content represented by the input audio information are provided. For example, the bandwidth extension provider 130 may provide a control parameter which indicates whether one or four sets of spectral envelope parameters are provided per audio frame. For example, the control parameters provided by the bandwidth extension information provider 130 may be similar to, or even equal to, the parameters provided for the case "FIXFIX" in the syntax element "sbr_grid( )", as described in the International Standard ISO/IEC 14496-3.

However, the bandwidth extension provider 130 may, alternatively, be configured to provide a control information which is similar to, or even equal to, the control information included in the bitstream element "sbr_ld_grid( )", which is described, for example, in section 4.6.19.3.2 of the International Standard ISO/IEC 14496-3.

For example, a 2-bit value may be used to encode how many sets of envelope shape parameters are provided by the bandwidth extension information provider 130 per audio frame (cf. the bitstream element "bs_num_env" as described in section 4.6.19.3.2 of ISO/IEC 14496-3).

Advantageously, the signaling may be performed as indicated for the case "FIXFIX", which is described in section 4.6.19 "low delay SBR" of ISO/IEC 14496-3.

To conclude, the bandwidth extension information provider 130 provides bandwidth extension information 132, wherein the temporal resolution (for example, the period of time between updates of parameters representing a spectral envelope of a high frequency portion of the audio content represented by the input audio information 110) is adjusted in dependence on the temporal resolution adjustment information 122, which is provided by the detector 120. Thus, the temporal resolution used by the bandwidth extension information provider 130 (for example, for providing updated sets of parameters describing a spectral envelope of a high frequency portion of an audio content represented by the input audio information 110) is adapted to the input audio information 110.

For example, the audio encoder 100 is configured such that the temporal resolution used by the bandwidth extension information provider 130 is increased (when compared to a normal temporal resolution) in response to a detection of an onset of a fricative or affricate by the detector 120. However, the temporal resolution used by the bandwidth extension information provider is increased such that the bandwidth extension information (for example, the spectral envelope parameters thereof) is provided with an increased temporal resolution at least for a predetermined period of time before a time at which an onset of a fricative or affricate is detected and for a predetermined period of time following the time at which the onset of a fricative or affricate is detected. Accordingly, an "entire" onset of a fricative or affricate (or at least a sufficiently large portion of an onset of a fricative or affricate) is encoded with an increased temporal resolution of the bandwidth extension information. Consequently, onsets of a fricative or affricate can be encoded (and decoded) with sufficient accuracy, such that audible artifacts are avoided and a degradation of the audio quality is also avoided.

Consequently, the encoded audio information 112, which comprises the bandwidth extension information 132 and which typically also comprises the encoded representation 142 of the low frequency portion of the audio content represented by the input audio information 110, allows for a decoding of the audio content represented by the input audio information 110 with good quality while a necessitated bitrate can be kept reasonably small.

Moreover, it should be noted that any of the other features and functionalities described herein can be implemented into the audio encoder 100 as well. In particular, the audio encoder 100 may additionally be configured to adjust the temporal resolution used by the bandwidth extension information provider such that bandwidth extension information is provided with an increased temporal resolution in response to a detection of an offset of a fricative or affricate (wherein the detector 110 may also be configured to detect an offset of a fricative or affricate).

In the following, some additional details regarding the functionality of the audio encoder 100 will be described taking reference to FIGS. 2-7.

Figure 2:
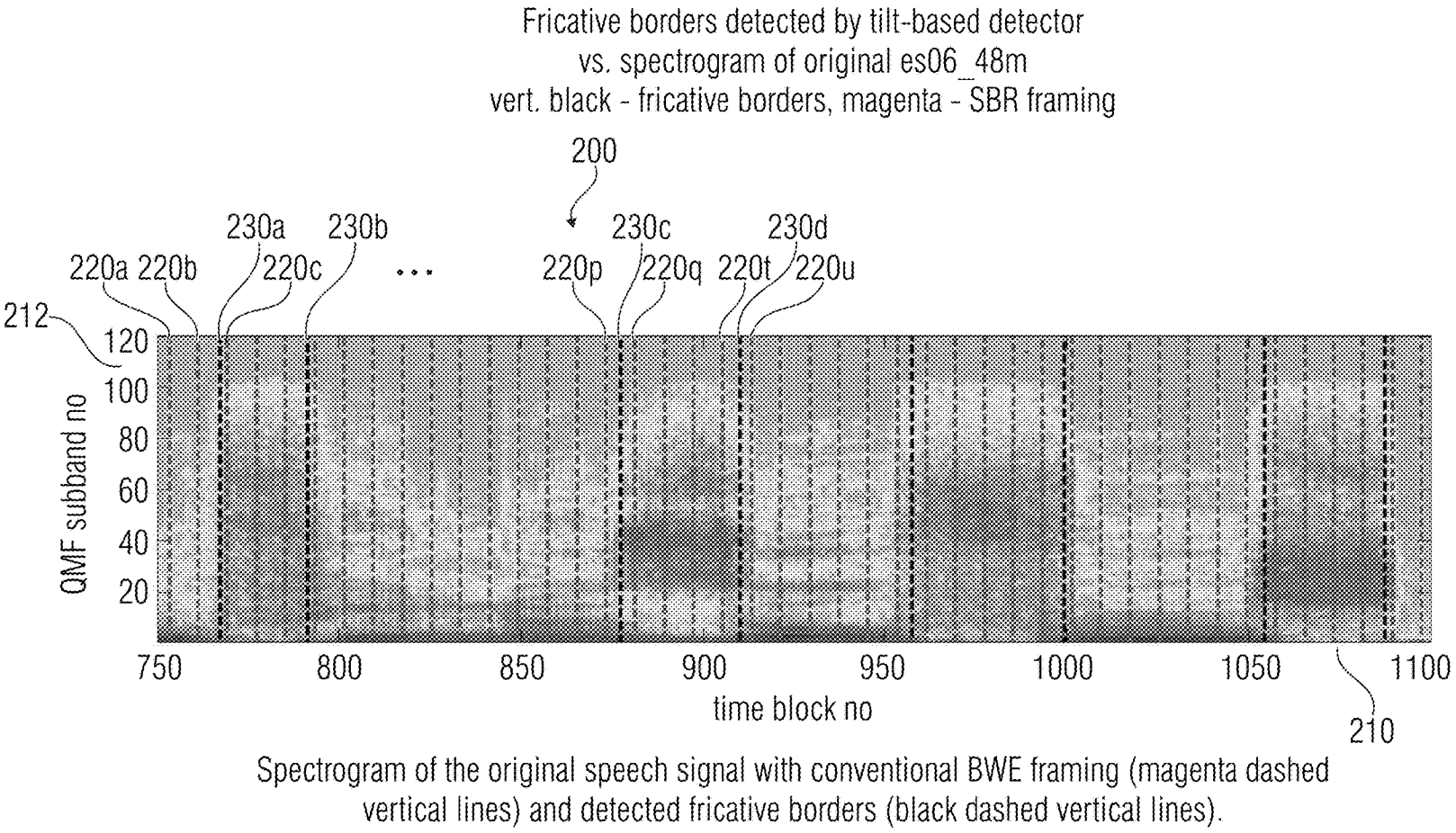
FIG. 2 shows a spectrogram of an original speech signal with conventional bandwidth extension (BWE) framing and detected fricative or affricate borders.

FIG. 2 shows a spectrogram of an original speech signal with conventional bandwidth extension framing and detected fricative or affricate borders.

An abscissa 210 describes a time (in terms of time blocks) and an ordinate 212 designates QMF subbands. Accordingly, the representation 200 according to FIG. 2 represents a distribution of an audio signal energy to different QMF subbands over time.

As can be seen, magenta dashed vertical lines designate temporal borders 220*a*, 220*b*, . . . of a conventional bandwidth extension framing. Moreover, black dashed vertical lines designate detected fricative or affricate borders 230*a*, 230*b*, 230*c*, 230*d*, . . . . The detected fricative or affricate borders 230*a*, 230*b*, 230*c*, 230*d*, . . . may be detected using a tilt-based detector. As can be seen, time intervals of equal length, which may be considered as bandwidth extension frames or generally as frames, are defined by the borders 220*a*, . . . , 220*u* of the (conventional) bandwidth extension framing. In other words, in the conventional concept according to document D1, bandwidth extension information may be associated with temporally regular time intervals (separated by the borders of the conventional bandwidth extension framing) of equal temporal length.

As can be seen, the detected fricative or affricate borders may lie somewhere within a time interval defined by two subsequent borders of the conventional bandwidth extension framing.

However, the conventional bandwidth extension frame scheme as shown in FIG. 2 does not allow for a particularly good reproduction of a high frequency portion of an audio content, as will be described later.

Figure 3:
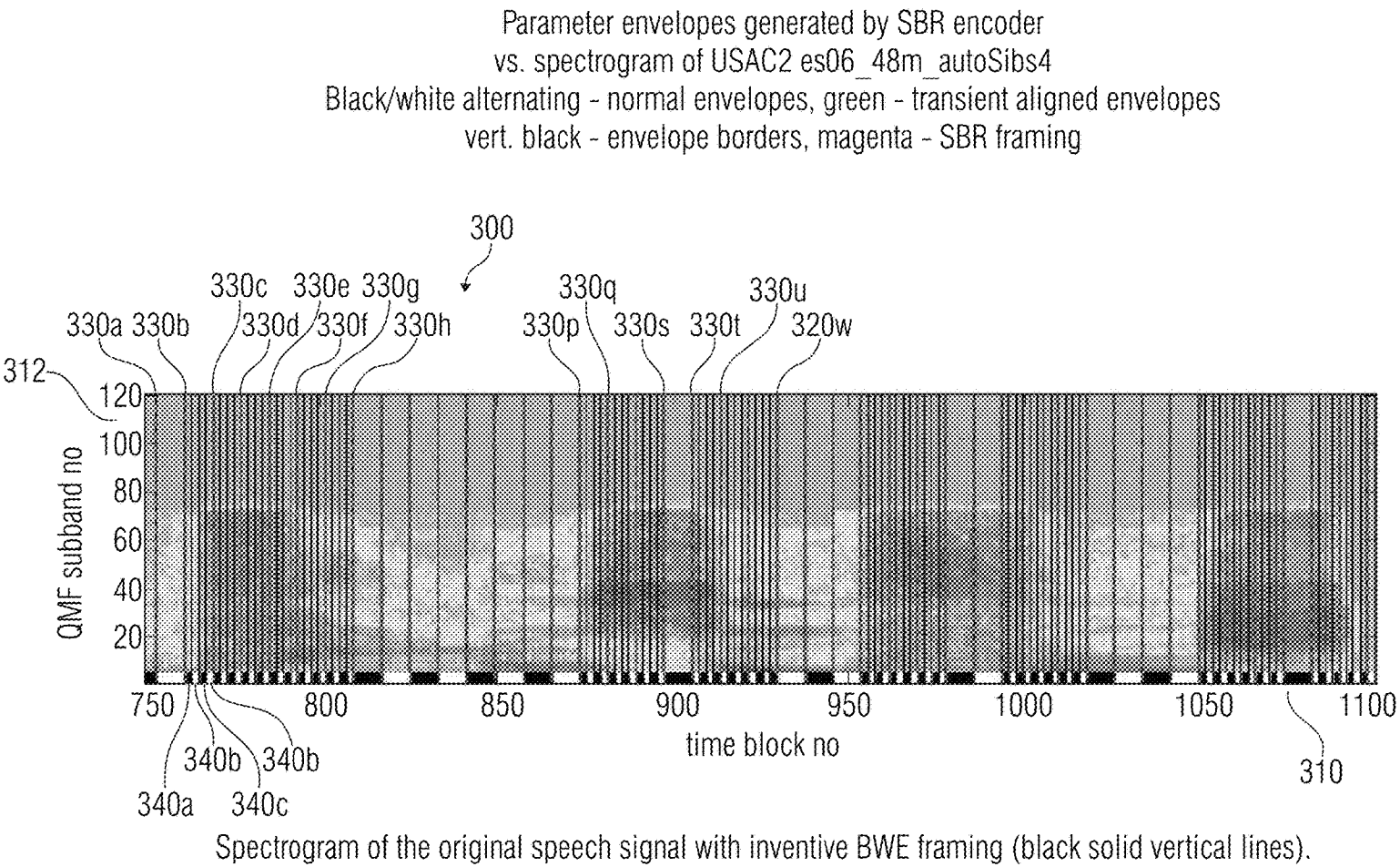
FIG. 3 shows a spectrogram of an original speech signal with inventive bandwidth extension (BWE) framing.

FIG. 3 shows a spectrogram of the original speech signal with the inventive bandwidth extension framing (wherein the inventive bandwidth extension framing is indicated by black solid vertical lines). An abscissa 310 describes a time, in terms of time blocks, and an ordinate 312 describes a frequency in terms of QMF subbands. The spectrogram 300 of FIG. 3 shows a distribution of energies (or generally, intensities) of an audio content (or audio signal) over frequency (or over QMF subbands) and over time. As can be seen, there is still a regular (basic, or fundamental) framing, which is indicated by vertical lines 330*a*-330*u*, wherein frames between two subsequent frame borders (for example, between frame borders 330*a* and 330*b*, or between frame borders 330*b* and 330*c*) can be considered as time intervals of equal length. However, it should be noted that a temporal resolution is increased in response to a detection of an onset of a fricative or affricate and also in response to the detection of an offset of a fricative or affricate. For example, a detection of an onset of a fricative or affricate in a time interval between frame borders 330*b* and 330*c* has the effect that the frame (or time interval) between frame borders 330*b* and 330*c* is subdivided into four sub-frames (or time sub-intervals) 340*a*, 340*b*, 340*c*, 340*d*. Moreover, it should be noted that, in response to the detection of an onset of a fricative or affricate between frame borders 330*b* and 330*c*, a temporal resolution is increased not only in the frame between frame borders 330*b* and 330*c*, but also in two subsequent frames bounded by frame borders 330*c* and 330*d*, and by frame borders 330*d* and 330*e*. Thus, in response to the detection of an onset of a fricative or affricate in a single frame (or time interval), namely the time interval bounded by frame borders 330*b* and 330*c*, an increased temporal resolution is applied for two additional frames (namely frames bounded by frame borders 330*c* and 330*d* and by time borders 330*d* and 330*e*). Accordingly, it can be ensured that an increased temporal resolution (when compared to a standard temporal resolution) is used for the provision of bandwidth extension information (or bandwidth extension parameters) over the duration of an entire onset of a fricative or affricate (or at least over a large portion of the onset of the fricative or affricate). Thus, the decoder-sided bandwidth extension can be performed with an increased temporal resolution over the entire onset of the fricative or affricate, since individual sets of bandwidth extension parameters (for example, parameters describing an envelope of a high frequency portion of an audio content) may be provided for each of the time sub-intervals (for example, for each of the time sub-intervals 340*a*-340*d*). Moreover, it can be seen that, in response to the detection of an offset of a fricative or affricate in a frame between frame borders 330*e* and 330*f*, an increased temporal resolution is applied to three subsequent frames, namely the frames bounded by frame borders 330*e* and 330*f*, by frame borders 330*f* and 343*g*, and by frame borders 330*g* and 330*h*. In other words, the frames between frame borders 330*e* and 330*h* are all subdivided into four sub-frames (or time sub-intervals) each, wherein an individual set of bandwidth extension parameters is provided for each of the sub-frames (or time sub-intervals). Thus, bandwidth extension parameters can be provided with an increased temporal resolution for an entire offset of the fricative or affricate detected in the time interval bounded by frame borders 330*e* and 330*f*.

However, between frame borders 330*h* and 330*p*, a "normal" temporal resolution (rather than an "increased" temporal resolution) is used. Moreover, an increased temporal resolution is used for the provision of the bandwidth extension information for frames between frame borders 330*p* and 330*s*, in response to a detection of an onset of a fricative or affricate in a frame (or time interval) bounded by frame borders 330*p* and 330*q*.

Similarly, an increased temporal resolution is used for the provision of bandwidth extension information for frames (or time intervals) between frame borders 330*t* and 330*w* in response to a detection of an offset of a fricative or affricate in a frame (or time interval) between frame borders 330*t* and 330*u*.

To conclude, a uniform (basic) framing is used to provide bandwidth extension information in the audio encoder 100, wherein the bandwidth extension information is associated with temporally regular frames (time intervals) of equal temporal length.

However, the bandwidth extension information provider is configured to provide a single set of bandwidth extension information for a frame (i.e., a time interval of a given temporal length) if a first ("normal") temporal resolution is used. For example, a single set of bandwidth extension information is provided for a frame between frame borders 330*a* and 330*b*, and a single set of bandwidth extension information is provided for each of the eight frames between time borders 330*h* and 330*p*. However, the bandwidth extension information provider is also configured to provide a plurality of sets of bandwidth extension information associated with time sub-intervals for a frame (time interval) of the given temporal length if a second (increased) temporal resolution is used. For example, four sets of bandwidth extension information are provided for each of the six frames between frame border 330*b* and frame border 330*h*, for each of the three frames between frame borders 330*p* and 330*s*, and for each of the three frames between frame borders 330*t* and 330*w*. As can be seen, each of the frames for which the bandwidth extension information is provided with high temporal resolution is subdivided into four sub-frames (or time sub-intervals) (for example, time sub-intervals 340*a* to 340*d*) of equal length, wherein one set of bandwidth extension parameters is provided for each of the time sub-intervals. Moreover, it should be noted that there is typically at least one time sub-frame, for which a set of bandwidth extension parameters is provided, immediately before a time sub-frame during which an onset of a fricative or affricate is detected or before a time sub-frame during which an offset of a fricative or affricate is detected. For example, if it is assumed that a fricative or affricate is detected in a second half of the frame between frame borders 330*b* and 330*c*, there are at least two time sub-frames (which lie in a first half of the frame between frame borders 330*b* and 330*c*) immediately preceding a time sub-frame during which the fricative or affricate is detected. Accordingly, an increased temporal resolution is used for the provision of the bandwidth extension parameters even before the time at which the onset of the fricative or affricate is actually detected or before the time at which the offset of the fricative or affricate is actually detected. Accordingly, a "full" onset of a fricative or affricate or a "full" offset of a fricative or affricate can be processed with high temporal resolution (in that the bandwidth extension parameters are provided with high temporal resolution). Consequently, a good reproduction is possible at the side of an audio decoder, which receives the audio encoded audio information provided by the audio encoder 100.

Taking reference now to FIGS. 4 and 5, some advantages of the audio encoder 100 over conventional audio encoders will be described.

Figure 4:
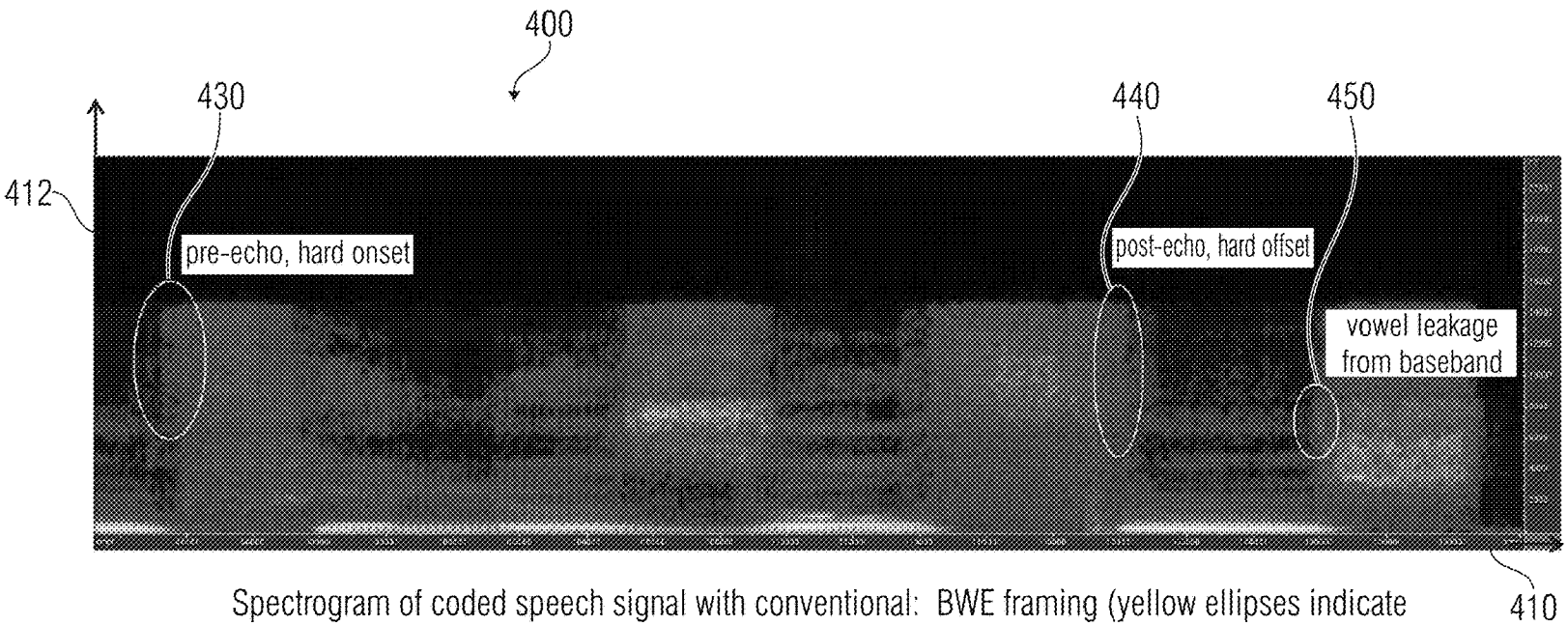
FIG. 4 shows a spectrogram of coded speech with conventional bandwidth extension (BWE) framing.

FIG. 4 shows a spectrogram of coded speech with a conventional bandwidth extension framing. An abscissa 410 describes a time, and an ordinate 412 describes a frequency. Moreover, yellow ellipses indicate typical artifacts caused by the conventional bandwidth extension framing. The spectrogram 400 of FIG. 4 thus describes an energy of a speech signal over frequency and over time.

A first ellipse 430 describes a pre-echo which would be caused by a conventional bandwidth extension framing. Mover, the conventional bandwidth extension framing has the effect that the onset shown in the ellipse 430 is perceived as a very hard onset.

Moreover, a second ellipse 440 points out a post echo, which would also be caused by a conventional bandwidth extension framing. Moreover, the offset in the region indicated by the ellipse 440 would typically be perceived as a very hard offset, which would sound unnatural.

An ellipse 450 shows a vowel leakage from a base band, which would also be caused by a conventional bandwidth extension framing.

Accordingly, it can be seen that a number of artifacts arise from the conventional bandwidth extension framing (for example, the bandwidth extension framing shown in FIG. 2).

Figure 5:
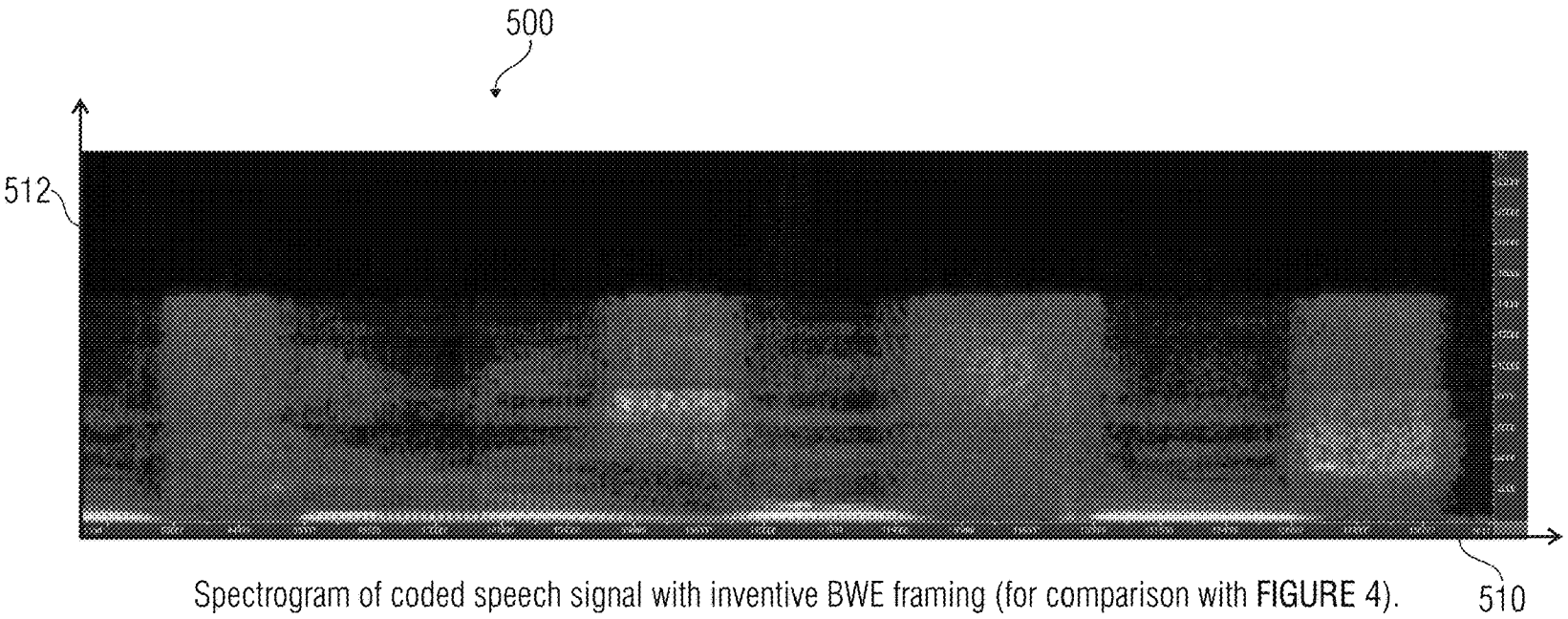
FIG. 5 shows a spectrogram of coded speech with an inventive bandwidth extension (BWE) framing.

FIG. 5 shows a spectrogram of coded speech with an inventive bandwidth extension framing (for comparison with the spectrogram of FIG. 4). Again, an abscissa 510 describes a time and an ordinate 512 describes a frequency, such that the spectrogram 500 represents an energy of the coded speech signal (or of a decoded speech signal derived from the coded speech signal) as a function of frequency and as a function of time. As can be seen, the problematic areas highlighted by ellipses 430, 440, 450, as indicated in FIG. 4, are substantially improved. In other words, the usage of a high temporal resolution for the provision of the bandwidth extension information helps to reduce, or even avoid, pre-echoes, an inappropriately hard perception of an onset of a fricative or affricate, post-echoes at the offset of a fricative or affricate and an inappropriately hard perception of an offset of a fricative or affricate.

Moreover, the inventive usage of an increased temporal resolution also helps to avoid a vowel leakage from a base band, as shown at ellipse 450 in FIG. 4.

In the following, some details regarding the provision of the bandwidth extension information will be explained taking reference to FIGS. 6 and 7.

Figure 6:
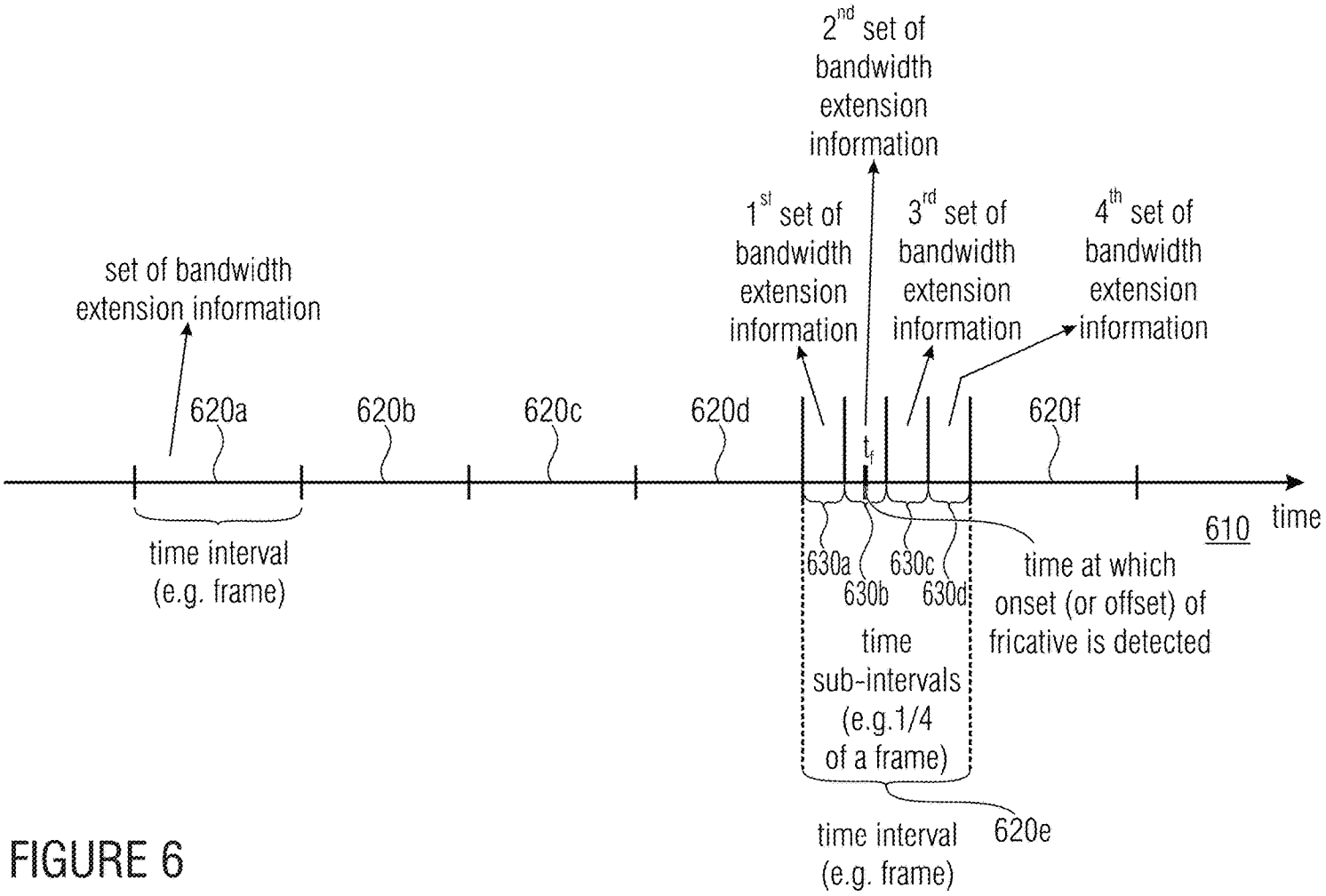
FIG. 6 shows a schematic representation of time intervals and time sub-intervals for which sets of bandwidth extension information are provided in an embodiment according to the invention.

FIG. 6 shows a schematic representation of time intervals and time sub-intervals which are used for a provision of a bandwidth extension information.

A time axis is designated with 610. As can be seen, the time (represented by the time axis 610) is divided into time intervals 620*a*, 620*b*, 620*c*, 620*d*, 620*e*, 620*f*, which may, for example, comprise equal length. The time intervals may be considered as frames. Moreover, a time at which an onset (or offset) of a fricative or affricate is detected is designated with $t_f$. The time $t_f$ lies within the time interval (or frame) 620*e*. It should be noted that the time at which the onset (or offset) of the fricative or affricate is detected may, for example, be determined by the detector 120, and that the time at which the onset (or offset) of the fricative or affricate is detected may typically lie somewhat after an actual beginning of an onset of the fricative or affricate or after an actual beginning of the offset of the fricative or affricate.

As can be seen in FIG. 6, the bandwidth extension information is provided with a "normal" (comparatively low) resolution for the time intervals 620*a* to 620*d* and 620*f*. For example, one set of bandwidth extension information is provided for each of the time intervals 620*a* to 620*d* and 620*f*. For example, a common spectral shape (or spectral shaping) is represented by a set of bandwidth extension parameters for each of the time intervals 620*a* to 620*d* and 620*f*, such that the bandwidth extension information does not represent a change of a spectral shape (or spectral shaping) within a single one of the time intervals 620 to 620*d* and 620*f*. In contrast, the audio decoder 100 is configured to adjust the temporal resolution used by the bandwidth extension information provider such that the bandwidth extension information is provided with an increased temporal resolution in the time interval (or frame) 620*e*. Accordingly, the bandwidth extension information provider 130 may subdivide the time interval 620*e* into four time sub-intervals 630*a* to 630*d* in response to the detection of the onset (or offset) of a fricative or affricate time $t_f$ within the time interval 620*e*. Accordingly, the bandwidth extension information provider may provide one set of bandwidth extension information for each of the time sub-intervals 630*a* to 630*d*. Accordingly, a first set of bandwidth extension information (e.g. parameters) provided for time sub-interval 630*a* may describe a spectral shape (or a spectral shaping) to be applied in the bandwidth extension of the time sub-interval 630*a*, a second set of bandwidth extension information my describe a spectral shape or spectral shaping to be applied in a bandwidth extension of the time sub-interval 630*b*, a third set of bandwidth extension information may describe a spectral shape or a spectral shaping to be applied in the bandwidth extension of the time sub-interval 630*c*, and a fourth set of bandwidth extension information may describe a spectral shape or a spectral shaping to be applied in a bandwidth extension of the time sub-interval 630*d*. Accordingly, the individual sets of bandwidth extension information (or bandwidth extension parameters) are provided by the bandwidth extension information provider 130, such that the spectral shape or spectral shaping to be applied in a bandwidth extension of the time-intervals 630*a* to 630*d* is signaled independently. Accordingly, a spectral shape or spectral shaping is encoded with increased temporal resolution (which is higher than the "normal" or "low" temporal resolution) for the time interval 620*e* in response to the detection of the onset or offset of a fricative or affricate within the time interval 620*e*. However, it should be noted that the time interval 630*a* to 630*d* may be of equal length (for example in terms of time or in terms of a number of samples). Moreover, it should be noted that the increased temporal resolution for the provision of the bandwidth extension information is already used in the time sub-interval 630*a*, i.e., before the time $t_f$ at which the onset or offset of the fricative or affricate is detected. Moreover, the increased temporal resolution is also used in the time sub-interval 630*c*, i.e., after the time interval 630*b* during which the onset or offset of the fricative or affricate is detected. Accordingly, the onset or offset of the fricative or affricate can be encoded with good audio quality.

Figure 7:
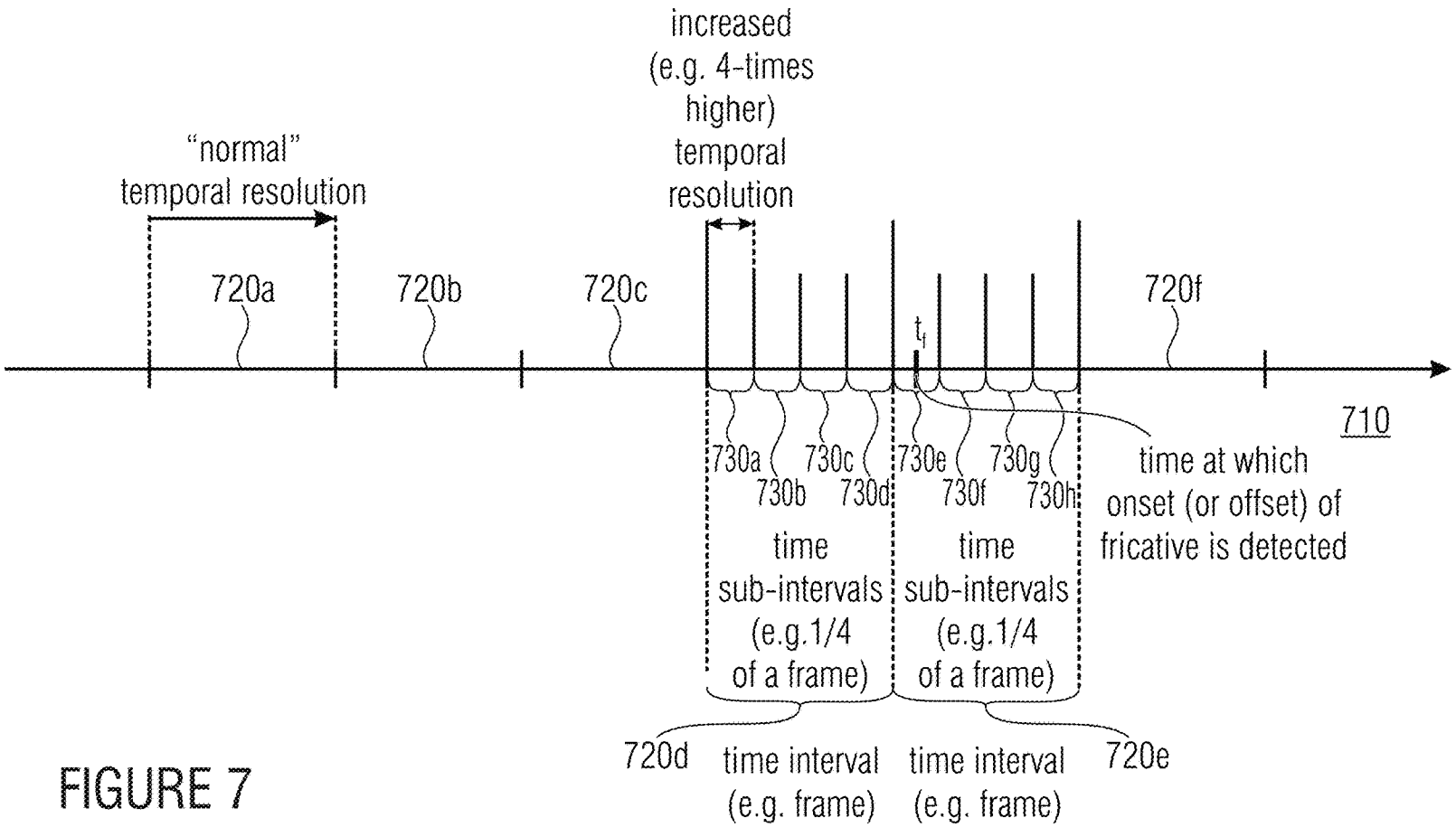
FIG. 7 shows a schematic representation of time intervals and time sub-intervals for which sets of bandwidth extension information are provided in an embodiment according to the invention.

FIG. 7 shows another schematic representation of temporal resolution used for the provision of bandwidth extension information. A time axis is designated with 710. As can be seen, there are time intervals 720*a* to 720*f*. As can be further seen, a time at which an onset (or offset) of a fricative or affricate is detected is designated with $t_f$ and lies within a first quarter of time interval 720*e*. As can be seen, a bandwidth extension information is provided with "normal" or "low" temporal resolution (for example, one set of bandwidth extension information or one set of bandwidth extension parameters per time interval) for time intervals 720*a*, 720*b*, 720*c* and 720*f*. However, in response to the detection that there is an onset of a fricative or affricate at time $t_f$, the audio encoder 100 adjusts the temporal resolution used by the bandwidth extension information provider such that an "increased" (or "high") temporal resolution is used during time intervals 720*d* and 720*e*. Accordingly, individual sets of bandwidth extension information (or bandwidth extension parameters) are provided for four time sub-intervals of time interval 720 and for four time sub-intervals of time interval 720*e*. Thus, a spectral envelope or spectral envelope shaping, to be used for a bandwidth extension (at the side of an audio decoder), is represented (or encoded) with an increased spectral resolution during time intervals 720*d* and 720*e*.

For example, one individual set of bandwidth extension parameters may be provided for each time sub-interval of the time intervals 720*d* and 720*e*.

However, it should be noted that the increased temporal resolution is also used for the time interval 720*d* which precedes (immediately precedes) the time interval 720*e*, in which the time at which the onset (or offset) of the fricative or affricate is detected lies. However, as it is desired, according to the present invention, that at least another time interval (or time sub-interval), preceding (or immediately preceding) the time interval (or time sub-interval) in which the onset (or offset) of the fricative or affricate is detected, is encoded with an increased temporal resolution, the audio encoder 100 chooses the increased temporal resolution for the provision (and encoding) of the bandwidth extension information of the time interval 720*d*. Thus, since the time at which the onset of the fricative or affricate is detected lies within a first time sub-interval of the time interval 720*e*, the audio decoder decides that also the (preceding) time interval 720*d* should be processed with high temporal resolution, such that the high temporal resolution is already applied in a time interval (or time sub-interval) before the time sub-interval in which the onset (or offset) of the fricative or affricate is detected.

In contrast, if the onset (or offset) of the fricative or affricate was only detected in a second sub-interval of the time interval 720*e*, the audio encoder would (possibly) select a low temporal resolution for the provision of the bandwidth extension information for the time interval 720*d* (which is the situation shown in FIG. 6). Accordingly, it is apparent from FIG. 7 that a certain "temporal look-ahead" is performed in that an increased temporal resolution is chosen for the provision of the bandwidth extension information even if this would not be necessitated by the framing.

Accordingly, even a beginning of an onset of a fricative or affricate is processed with high temporal resolution, wherein the beginning of the onset of the fricative or affricate typically lies before a time at which the onset of a fricative or affricate is actually detected by the detector 120. Consequently, audio reproduction with good perceptual quality without major artifacts can be achieved.

To summarize, FIGS. 3, 5, 6 and 7 show operating concepts which may be applied in the audio encoder 100 according to the present invention. However, different framing concepts can actually be used as long as it is ensured that the bandwidth extension information is provided with an increased temporal resolution (when compared to a normal temporal resolution) at least for a predetermined period of time before a time at which an onset of a fricative or affricate (or an offset of a fricative or affricate) is detected and for a predetermined period of time following the time at which the onset of the fricative or affricate (or the offset of the fricative or affricate) is detected.

It should be noted that FIGS. 6 and 7 represent, for example, a structure of an encoded audio signal. For example, the encoded audio signal may comprise an encoded representation of a low frequency portion of an audio content. Moreover, the encoded audio representation may comprise a plurality of sets of bandwidth extension parameters.

For example, one set of bandwidth extension parameters may be provided for each of the frames 620*a* to 620*d* and 620*f*. Moreover, one set of bandwidth extension information may be provided for each of the frames 720*a*, 720*b*, 720*c*, 720*f*. However, sets of bandwidth extension parameters may be provided with an increased temporal resolution at least for a predetermined period of time before a time at which an onset of a fricative or affricate is detected and for a predetermined period of time following the time at which the onset of the fricative or affricate is detected. For example, sets of bandwidth extension parameters are provided with increased temporal resolution for the frame 620*e*. For example, a total of four sets of bandwidth extension parameters may be provided for the frame 620*e* such that the temporal resolution is increased in the sub-frame 630*a* preceding the sub-frame 630*b* in which the onset or offset of the fricative or affricate is detected. Moreover, two more sets of bandwidth extension parameters may be provided for sub-frames 630*c* and 630*d*.

A similar concept is apparent from FIG. 7, wherein sets of bandwidth extension parameters are provided with an increased temporal resolution for frame 620*d* and 620*e*.

To conclude bandwidth extension parameters may be provided with an increased temporal resolution at least for a predetermined period of time before a time at which an onset of a fricative or affricate is detected and for a predetermined period of time following the time at which the onset of the fricative or affricate is detected. Moreover, the bandwidth extension parameters may also be provided with increased temporal resolution for a portion of the audio content in which an offset of a fricative or affricate is detected.

2. Audio Encoder According to FIG. 8

Figure 8:
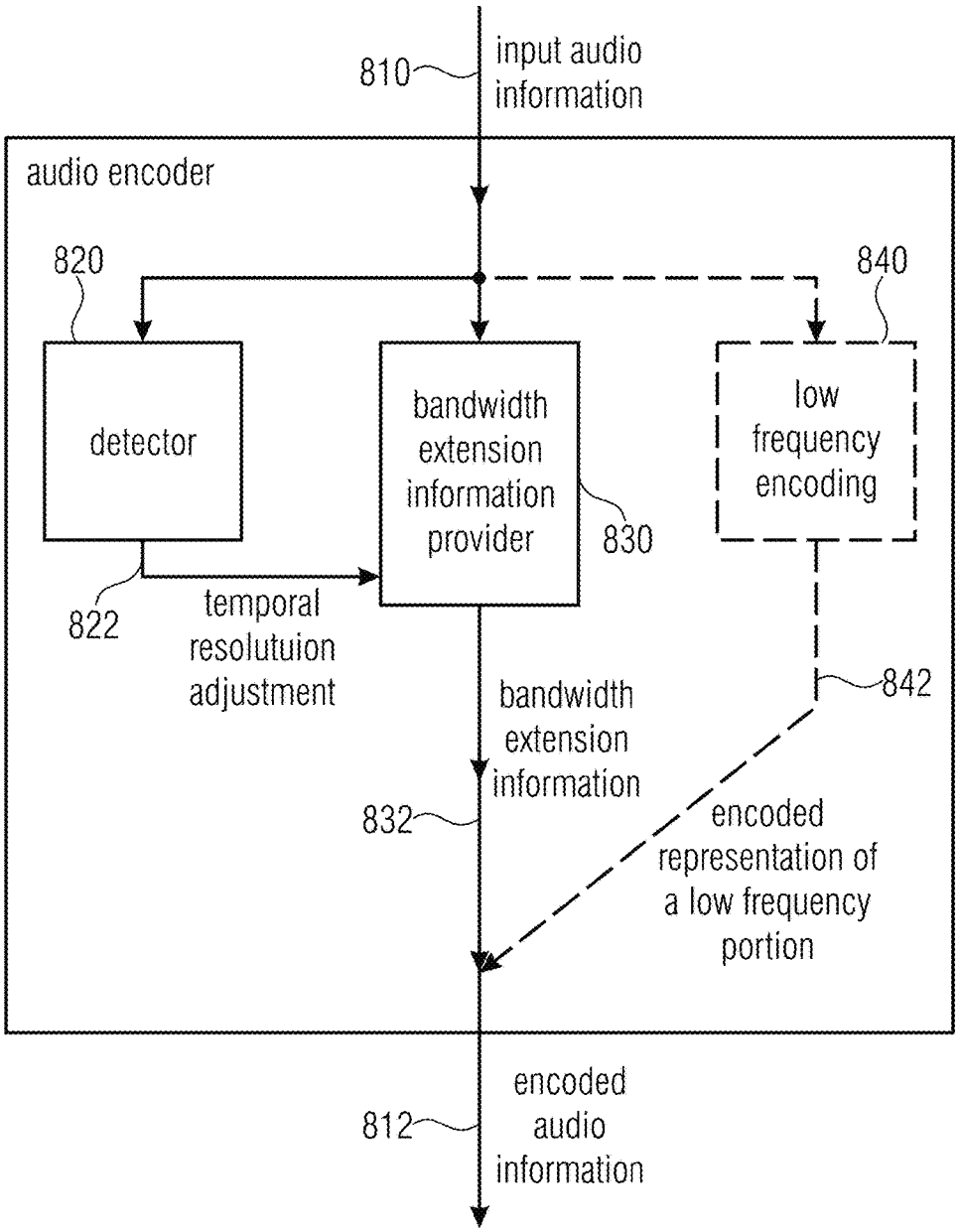
FIG. 8 shows a block schematic diagram of an audio encoder, according to another embodiment of the present invention.

FIG. 8 shows a block schematic diagram of an audio encoder according to an embodiment of the present invention.

The audio encoder 800 is configured to receive an input audio information 810 and to provide, on the basis thereof, an encoded audio information 812.

The audio encoder 800 comprises a detector 820 configured to detect an offset of a fricative or affricate. The detector 820 provides, for example, a temporal resolution adjustment information 822. Moreover, the audio encoder 800 comprises a bandwidth extension information provider 830 which is configured to provide bandwidth extension information 832 using a variable temporal resolution. The audio encoder is configured to adjust the temporal resolution used by the bandwidth extension information provider 830 such that the bandwidth extension information 832 is provided with an increased temporal resolution (when compared to a "normal" temporal resolution) in response to a detection of an offset of a fricative or affricate. In other words, the temporal resolution which is used by the bandwidth extension information provider 830 is increased if the detector 820 detects an offset of a fricative or affricate, such that the offset of the fricative or affricate is encoded with comparatively high (higher than normal) temporal resolution of the bandwidth extension information (or bandwidth extension parameters) 832. Moreover, the audio encoder 800 comprises a low frequency encoding 840 which may provide an encoded representation 842 of a low frequency portion of an audio content represented by the input audio information 810.

Moreover, it should be noted that the detector 820 may be similar to the detector 120 described above, and that the bandwidth extension information provider 130 may be similar (or even equal to) the bandwidth extension information provider 130 described above. Moreover, the low frequency encoding 840 may be similar, or even equal to, the low frequency encoding 140 described above.

Moreover, the audio encoder 800 is configured to adjust the temporal resolution used by the bandwidth extension information provider 830 such that the bandwidth extension information 832 is provided with an increased temporal resolution in response to a detection of an offset of a fricative or affricate. Accordingly, an offset of a fricative or affricate is encoded with high temporal resolution (at least of the bandwidth extension information) which helps to avoid artifacts and brings along a natural hearing impression.

However, it should be noted that the audio encoder 800 may, optionally, be provided with any of the other features described above with respect to the audio encoder 100, and also with respect to FIGS. 3, 5, 6 and 7. Moreover, advantages which arise from usage of an increased temporal resolution in response to the detection of an offset of a fricative or affricate can be seen, for example, in FIG. 5.

Moreover, it should be noted that the concepts according to FIGS. 6 and 7 are applicable both in response to a detection of an onset of a fricative or affricate and in response to the detection of an offset of a fricative or affricate, and therefore also apply to the audio encoder according to FIG. 8.

3. Audio Decoder According to FIG. 9

Figure 9:
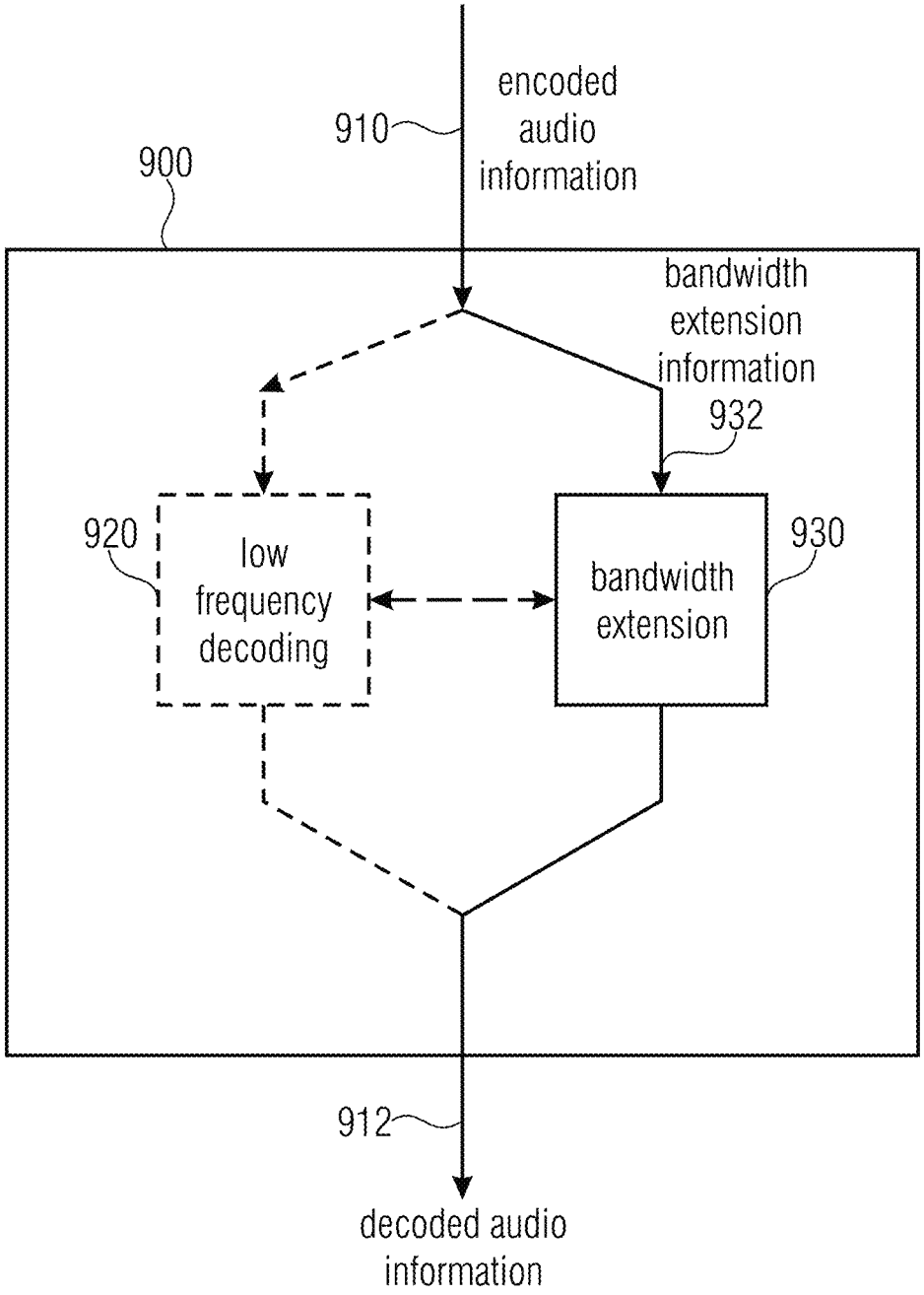
FIG. 9 shows a block schematic diagram of an audio decoder, according to another embodiment of the present invention.

FIG. 9 shows a block schematic diagram of an audio decoder, according to an embodiment of the invention. The audio decoder 900 is configured to receive an encoded audio information 910 and is to provide, on the basis thereof, a decoded audio information 912. The audio decoder comprises a low frequency decoding 920, which may be configured to provide a decoded representation of a low frequency portion of an audio content represented by the encoded audio information 910. For example, low frequency decoding 920 may comprise a general audio decoding, for example, as described in the International Standard ISO/IEC 14496-3. In other words, the low frequency decoding 920 may, for example, comprise a well-known MPEG-2 "advanced audio coding" (AAC) and may, for example, decode a low frequency portion of an audio content up to a frequency of approximately 6 kHz or 7 kHz. However, the low frequency decoding 920 may use any other decoding concept, such as, for example, the well known CELP decoding concept or the well-known transform-coded-excitation (TCX) decoding. Generally stated, the low frequency decoding 920 may use any general audio decoding concept or any speech decoding concept. The audio decoder 900 further comprises a bandwidth extension 930 which is configured to perform a bandwidth extension on the basis of a bandwidth extension information 932 which is provided by an audio encoder, and which is typically included in the encoded audio information 910. The bandwidth extension 930 may typically use information provided by the low frequency decoding 920. For example, the bandwidth extension 930 may be configured to perform a spectral bandwidth replication (SBR) on the basis of a decoded low frequency portion of the audio content (wherein the decoded low frequency portion of the audio content is provided by the low frequency decoding 920). For example, the bandwidth extension 930 may perform the functionality of the so-called "SBR tool" or of the so-called "low delay SBR" which is described, for example, in the International Standard ISO/IEC 14496-3.

However, the audio decoder 900 may be configured to perform the bandwidth extension with an increased temporal resolution at least for a predetermined period of time before a time at which an onset of a fricative or affricate is detected and for a predetermined period of time following the time at which the onset of the fricative or affricate is detected. Accordingly, a good audio quality may be achieved even for the onset of a fricative or affricate or for the offset of a fricative or affricate.

It should be noted that the temporal resolution, which is used for the bandwidth extension, may be signaled using a side information which is included in the bandwidth extension information 932. For example, the signaling may be performed as described in Section 4.6.19 of International Standard ISO/IEC 14496-3. In particular, the signaling of the temporal resolution may be performed as described in Section 4.6.19.3.2 of ISO/IEC 14496-3, subpart 4. Thus, the bandwidth extension 930 may evaluate said signaling to decide which temporal resolution should be used for the bandwidth extension.

However, alternatively, the audio decoder may be configured to detect an onset of a fricative or affricate or an offset of a fricative or affricate on the basis of the decoded low frequency portion of the audio content, which may be provided by the low frequency decoding 920. Accordingly, the audio decoder 900 may decide about the temporal resolution to be used for the bandwidth extension in a similar manner as the audio encoder described above. In such a case, it may not even be necessary to use any additional side information for signaling the temporal resolution to be used for the bandwidth extension which helps to reduce the bit rate.

Regarding the functionality of the audio decoder 900, it should be noted that the functionality corresponds to the functionality of the audio encoder 100 according to FIG. 1 and of the audio encoder 800 according to FIG. 8. In other words, the bandwidth extension is preformed with "normal" or comparatively "low" temporal resolution in the absence of an onset of a fricative or affricate or of an offset of a fricative or affricate, and the bandwidth extension is performed with a "increased" or comparatively "high" temporal resolution in the presence of an onset of a fricative or affricate or an offset of a fricative or affricate. However, the increased temporal resolution is also used for the bandwidth extension at least for a predetermined period before a time at which an onset of a fricative or affricate is detected and for a predetermined period of time following the time at which the onset of the fricative or affricate is detected, such that an entire onset of a fricative or affricate is processed with high temporal resolution of the bandwidth extension. Accordingly, artifacts can be avoided.

4. Audio Decoder According to FIG. 10

Figure 10:
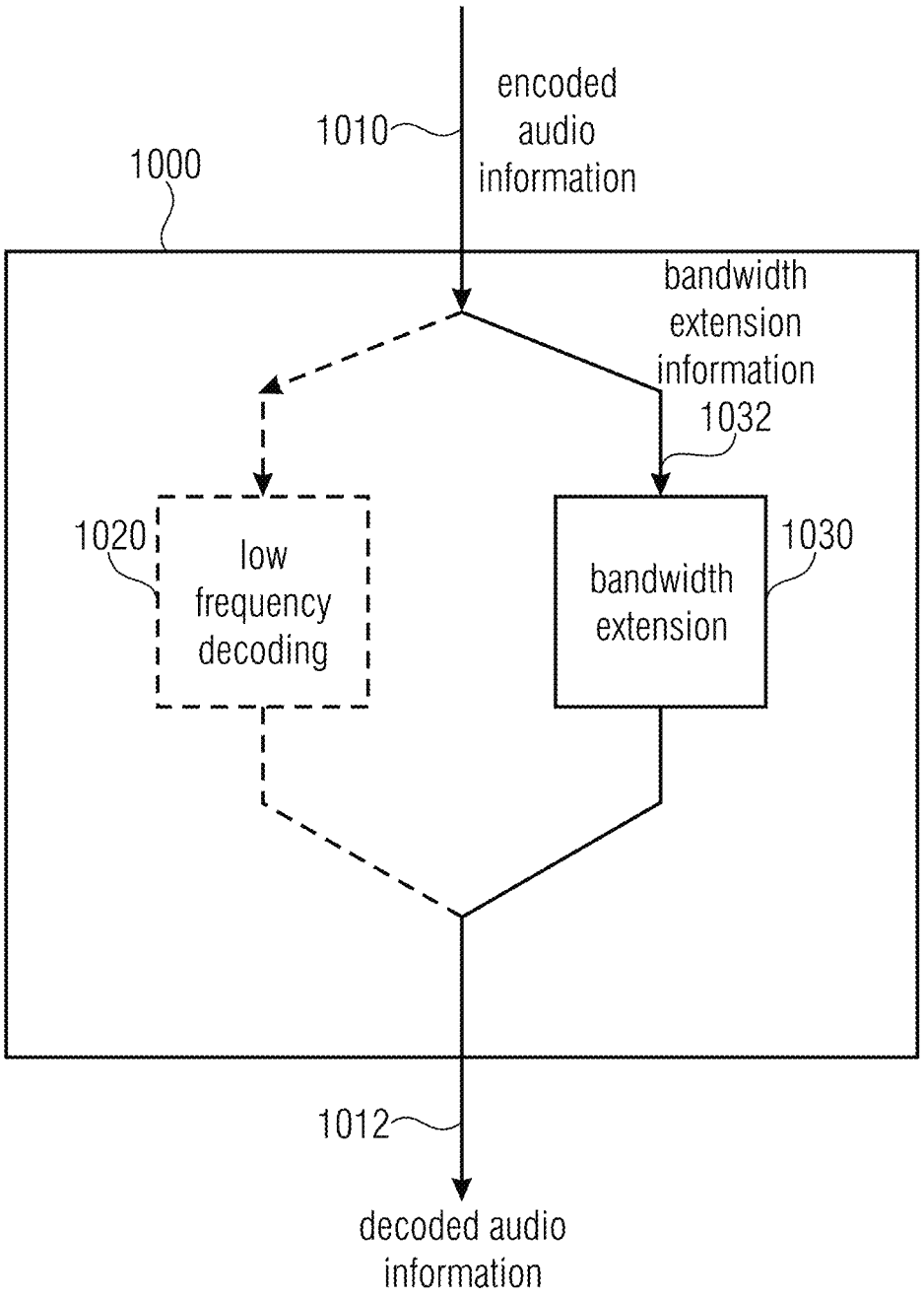
FIG. 10 shows a block schematic diagram of an audio decoder, according to another embodiment of the present invention.

FIG. 10 shows a block schematic diagram of an audio decoder, according to another embodiment of the present invention.

The audio decoder 1000 is configured to receive an encoded audio information 1010 and to provide, on the basis thereof, a decoded audio information 1012. The audio decoder comprises a low frequency decoding 1020, which may be substantially equal to the low frequency decoding 920 described above. Moreover, the audio decoder 1000 comprises a bandwidth extension 1030, which may be substantially equal to the bandwidth extension 930 described above. However, the audio decoder 1000 is configured to perform the bandwidth extension on the basis of a bandwidth extension information 1032 provided by an audio encoder, such that the bandwidth extension is performed with an increased temporal resolution at least for a predetermined period of time before a time at which an offset of a fricative or affricate is detected and for a predetermined period of time following the time at which the offset of the fricative or affricate is detected. Accordingly, the audio decoder 1000 provides a decoded audio information in which offsets of fricatives or affricates are represented with good accuracy. Accordingly, artifacts are avoided.

Moreover, it should be noted that the explanations provided above with respect to the audio decoder 900 also apply to the audio decoder 1000. In addition, it should be noted that the audio decoder 1000 can be supplemented by any of the features and functionalities described with respect to the audio encoder 900. Moreover, the audio encoder 1000 (as well as the audio encoder 900) can be supplemented by any of the features and functionalities described herein with respect to the audio decoder since the audio decoding corresponds to the audio encoding described above.

5. System According to FIG. 11

Figure 11:
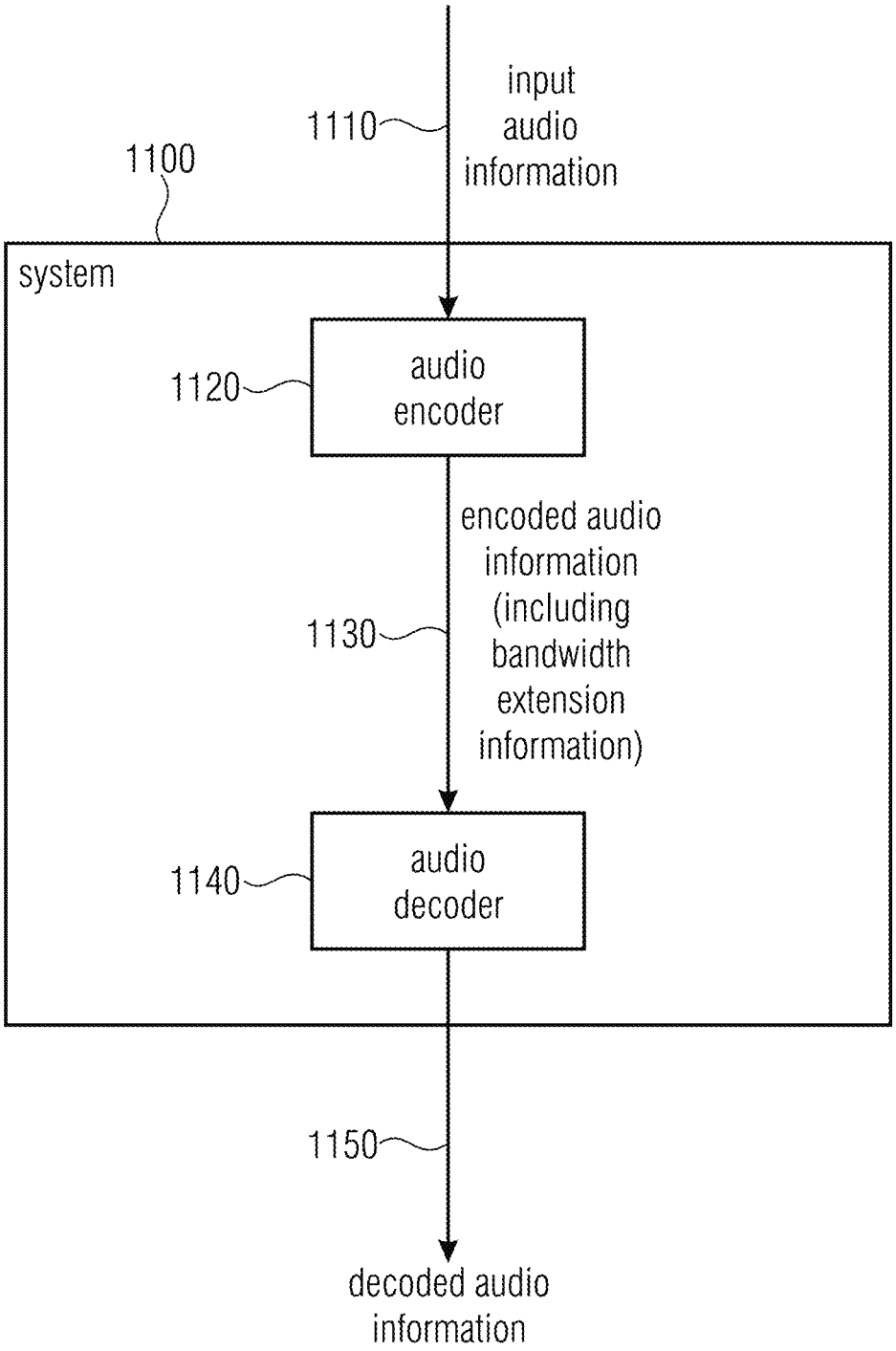
FIG. 11 shows a block schematic diagram of a system for audio encoding and audio decoding, according to an embodiment of the present invention.

FIG. 11 shows a block schematic diagram of a system, according to an embodiment of the present invention. The system 1100 comprises an audio encoder 1120, which is configured to receive an input audio information 1110 and to provide, on the basis thereof, an encoded audio information 1130 to an audio decoder 1140. The audio decoder 1140 is configured to provide a decoded audio information 1150 on the basis of the encoded audio information 1130.

However, it should be noted that the audio encoder 1120 may be equal to the audio encoder 100 described with respect to FIG. 1 or to the audio encoder 800 described with respect to FIG. 8. Moreover, the audio decoder 1140 may be equal to the audio decoder 900 described with respect to FIG. 9 or the audio decoder 1000 described with respect to FIG. 10. Accordingly, the audio decoder may be configured to receive the encoded audio information provided by the audio encoder, and to provide, on the basis thereof, the decoded audio information 1150, such that the bandwidth extension is performed with an increased temporal resolution at least for a predetermined period of time before a time at which an onset of a fricative or affricate is detected and for a predetermined period of time following the time at which the onset of the fricative or affricate is detected and/or such that the bandwidth extension is performed with an increased temporal resolution at least for a predetermined period of time before a time at which an offset of a fricative or affricate is detected and for a predetermined period of time following the time at which the offset of the fricative or affricate is detected. Accordingly, a good quality reproduction of fricatives or affricates can be achieved.

It should be noted that the system can be supplemented by any of the features and functionalities described above with respect to the audio encoders and audio decoders.

6. Method for Providing an Encoded Audio Information on the Basis of an Input Audio Information According to FIG. 12

Figure 12:
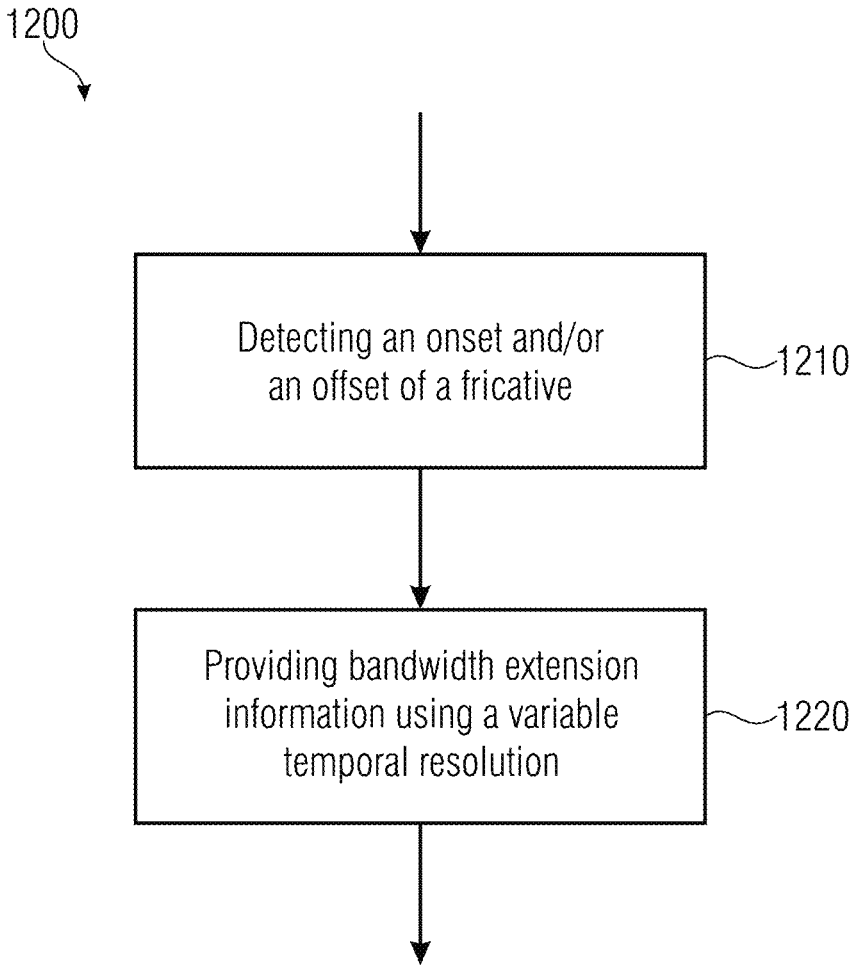
FIG. 12 shows a flowchart of a method for providing an encoded audio information on the basis of an input audio information, according to an embodiment of the present invention.

FIG. 12 shows a flow chart of a method for providing an encoded audio information on the basis of an input audio information. The method 1200 according to FIG. 12 comprises detecting an onset of a fricative or affricate and/or an offset of a fricative or affricate (step 1210). The method further comprises providing 1220 bandwidth extension information using a variable temporal resolution. The temporal resolution used for providing the bandwidth extension information may, for example, be adjusted such that the bandwidth extension information is provided with an increased temporal resolution at least for a predetermined period of time before a time at which an onset of a fricative or affricate is detected and for a predetermined period of time following the time at which the onset of the fricative or affricate is detected. Alternatively, the temporal resolution for providing the bandwidth extension information may be adjusted such that the bandwidth extension information is provided with an increased temporal resolution in response to a detection of an offset of a fricative or affricate.

The method 1200 according to FIG. 12 is based on the same considerations as the above described audio encoders. Moreover, the method 1200 can be supplemented by any of the features and functionalities described herein with respect to the audio encoder (and also with respect to the audio decoder).

7. Method for Providing a Decoded Audio Information According to FIG. 13

Figure 13:
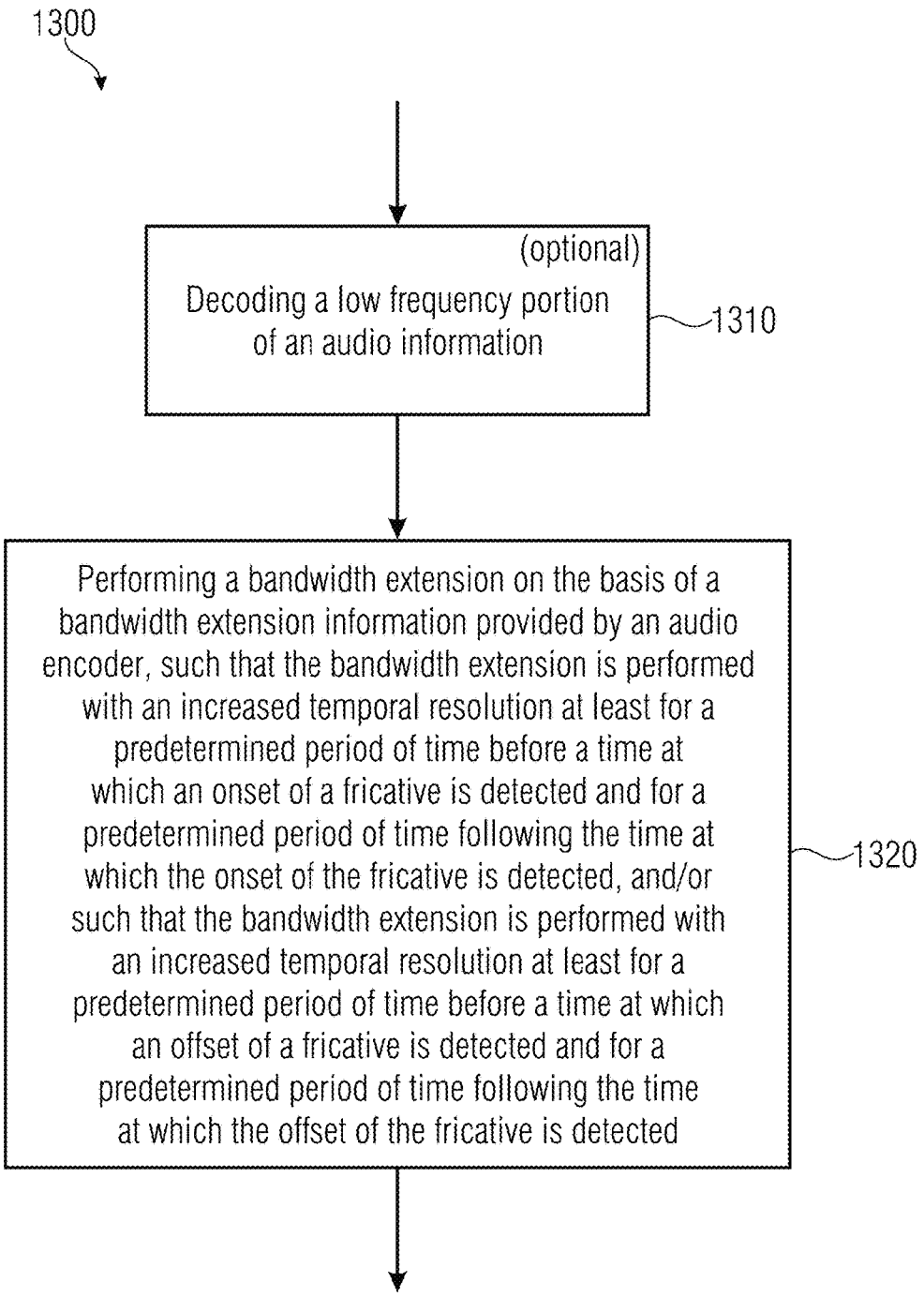
FIG. 13 shows a flowchart of a method for providing a decoded audio information on the basis of an input audio information, according to an embodiment of the present invention.

FIG. 13 shows a flow chart of a method for providing a decoded audio information, according to an embodiment of the invention. The method 1300 comprises decoding 1310 a low frequency portion of an audio information which, however, is not an essential step of the method.

The method 1300 further comprises performing 1320 a bandwidth extension on the basis of a bandwidth extension information provided by an audio encoder, such that a bandwidth extension is performed with an increased temporal resolution at least for a predetermined period of time before a time at which an onset of a fricative or affricate is detected and for a predetermined period of time following the time at which the onset of the fricative or affricate is detected and/or such that the bandwidth extension is performed with an increased temporal resolution at least for a predetermined period of time before a time at which an offset of a fricative or affricate is detected and for a predetermined period of time following the time at which the offset of the fricative or affricate is detected.

The method 1300 is based on the same considerations as the above described audio encoder and the above described audio decoder. Moreover, it should be noted that the method 1300 can be supplemented by any of the features and functionalities described herein with respect to the audio decoder. Moreover, the method 1300 can also be supplemented by any of the features and functionalities described with the respect to the audio encoder, taking into consideration that the decoding process is substantially an inverse of the encoding process.

8. Conclusions

To conclude the above explanations, it should be noted that embodiments according to the invention relate to speech coding and particularly to speech coding using bandwidth extension (BWE) techniques. Embodiments according to the invention aim to enhance the perceptual quality of the decoded signal by detecting fricatives or affricates within the speech signal and adapting the temporal resolution of the bandwidth extension parameter driven post processing accordingly (for example, by adapting a temporal resolution which is used for providing sets of bandwidth extension information). Embodiments according to the invention comprise detecting onsets and offsets of fricative or affricate signal portions of a speech signal and providing for a temporally fine-grain bandwidth extension post-processing during the entire onset and offset period of these fricative or affricate signal portions (wherein the bandwidth extension processing may, for example, comprise a provision of said bandwidth extension information at the side of an audio encoder and may comprise performing a bandwidth extension at the side of the audio decoder). Hereby, the occurrence of pre- and post-echo artifacts is reduced and a sufficiently gentle on- and offset of fricative or affricate signal portions can be modeled by the fine grain bandwidth extension parameters. Hereby, unpleasant auditory sharpness of fricatives or affricates and the occurrence of annoying pre- and post-echoes within the coded signal is avoided.

Embodiments according to the invention outperform conventional solutions. For example, in [1] it is proposed to align a start time instant of a bandwidth extension parameter frame with the point in time of a spectral tilt change. A spectral tilt change might denote an onset or a sudden offset of a fricative or affricate signal portion. The alignment technique proposed in [1] prevents the occurrence of pre-echoes of fricatives or affricates within bandwidth extension methods. However, only fricative or affricate onsets are detected and offsets are missed. Additionally, the above mentioned technique does not account for fine-grain modeling of the on- and offset spectral-temporal characteristics of the individual fricatives or affricates. Hence, the sound of these can be harsh and much too sharp.

In the following, some embodiments and aspects according to the invention will be described.

For example, an inventive bandwidth extension encoder comprises a fricatives or affricates detector and a bandwidth extension spectro-temporal resolution switcher.

The fricatives or affricates detector advantageously is capable to detect both fricatives or affricates onsets and offsets. A suitable low computational complexity realization of such a detector can be, for example, based on the evaluation of a zero crossing rate (ZCR) and an energy ratio (for details, confer, for example, references [2] and [3]). The detector may be additionally connected to a speech/music discriminator in order to restrict the subsequent inventive processing to speech signals only.

In some embodiments, a certain temporal look-ahead of the detector is desired or even necessitated, to be able to timely switch bandwidth extension resolution such that during the entire onset and offset signal portion length, fine grain temporal resolution is employed within the bandwidth extension parameter estimation/synthesis. The duration of the onset or offset signal portions can be either measured signal adaptively or assumed to be fixed to an empirically determined value. For example, a number of time intervals or time-sub intervals, which are processed with high temporal resolution in response to a detection of a fricative or affricate onset or fricative or affricate offset can be predetermined, or adjusted in dependence on signal characteristics. For example, a detected fricative or affricate might activate a four times higher temporal resolution during a group of several consecutive signal frames (e.g., two or three frames) that fully encompass the detected fricative or affricate onset or offset. Advantageously, but not necessarily, the group of high temporal resolution signal frames is approximately centered with respect to the detected fricative or affricate on- or offset, thereby covering the entire duration of the on- or offset. In case of a transient adaptive bandwidth extension framing, the activation of a higher temporal resolution during an entire group of signal frames triggered by the fricatives or affricates detection supersedes the transient adaptive framing.

In the following, some details regarding figures will be discussed.

FIG. 2 shows a spectrogram of an original speech signal with dashed magenta vertical bars depicting a conventional bandwidth extension framing. Black dashed bars denote fricative or affricate borders.

FIG. 3 shows a spectrogram of an original speech signal with an inventive bandwidth extension framing adapted to fricative or affricate borders that is denoted by the solid black vertical lines. At a point in time where a fricative or affricate border (onset or offset) has been detected, the resolution of bandwidth extension post-processing is refined by switching to a four times higher resolution during a group of three consecutive frames.

FIG. 4 depicts a resulting spectrogram of the same speech signal coded using conventional bandwidth extension framing. The yellow ellipses indicate artifacts caused by the conventional bandwidth extension framing (from left to right): A: pre-echo and hard onset; B: post-echo and hard offset; C: energy leakage from preceding vowel into the modeled fricative or affricate due to too coarse framing.

FIG. 5 depicts the resulting spectrogram of the same speech signal coded using the inventive bandwidth extension framing. The problematic areas as indicated in FIG. 4 are substantially improved.

To conclude, the spectrograms discussed here indicate that an audio quality can be substantially improved by applying the concept according to the present invention.

To further conclude, embodiments according to the invention create an audio encoder or a method of audio encoding or a related computer program, as described above.

Further embodiments according to the invention create an audio decoder or a method of audio decoding or a related computer program as described above.

Moreover, embodiments according to the invention create an encoded audio signal or storage medium having stored the encoded audio signal as described above.

9. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] United states patent number US 20110099018, "Apparatus and Method for Calculating Bandwidth Extension Data Using a Spectral Tilt Controlled Framing"

[2] D. Ruinskiy and N. Dadush and Y. Lavner, "Spectral and textural feature-based system for automatic detection of fricatives and affricates," IEEE 26th Convention of Electrical and Electronics Engineers in Israel (IEEEI), pp. 771-775, 2010.

[3] H. Fujihara and M. Goto, "Three techniques for improving automatic synchronization between music and lyrics: Fricative detection, filler model, and novel feature vectors for vocal activity detection", IEEE International Conference on Audio, Speech and Signal Processing, Las Vegas, USA, 2008.

The invention claimed is:

1. An audio encoder for providing an encoded audio information on the basis of an input audio information, the audio encoder comprising:

a bandwidth extension information provider configured to provide bandwidth extension information using a variable temporal resolution;

a detector configured to detect an onset of a fricative or an onset of an affricate;

wherein the audio encoder is configured to adjust a temporal resolution used by the bandwidth extension information provider such that bandwidth extension information is provided with an increased temporal resolution at least for a predetermined period of time before a time at which an onset of a fricative or an onset of an affricate is detected and for a predetermined period of time following the time at which the onset of the fricative or the onset of the affricate is detected;

wherein the bandwidth extension information provider is configured to provide the bandwidth extension information such that the bandwidth extension information is associated with temporally regular time intervals of equal temporal lengths, wherein the bandwidth extension information provider is configured to provide a single set of bandwidth extension information for a time interval of a given temporal length if a first temporal resolution is used, and wherein the bandwidth extension information provider is configured to provide a plurality of sets of bandwidth extension information associated with time sub-intervals for a time interval of the given temporal length if a second temporal resolution is used;

wherein the audio encoder is configured to adjust a temporal resolution used by the bandwidth extension information provider such that at least one time sub-interval, to which a set of bandwidth extension information is associated, immediately precedes another time sub-interval during which an onset of a fricative or an onset of an affricate is detected, such that in at least the one time sub-interval, which precedes the another time sub-interval in which an onset of a fricative or an onset of an affricate is detected, the increased temporal resolution is used;

wherein another set of bandwidth extension information is associated to the another time sub-interval.

2. The audio encoder according to claim 1, wherein the audio encoder is configured to switch from the first temporal resolution for the provision of the bandwidth extension information to the second temporal resolution for the provision of the bandwidth extension information in response to the detection of the onset of a fricative or the onset of an affricate, wherein the second temporal resolution is higher than the first temporal resolution.

3. The audio encoder according to claim 1, wherein the audio encoder is configured to sub-divide a given time interval of the given temporal length into four sub-intervals of equal lengths, if an increased temporal resolution is used to provide the bandwidth extension information for the given time interval of the given temporal length, such that four sets of bandwidth extension information are provided for the given time interval of the given temporal length.

4. The audio encoder according to claim 1, wherein the audio encoder is configured to selectively use an increased temporal resolution to provide bandwidth extension information for a first time interval of a given temporal length preceding a second time interval of the given temporal length, if an onset of a fricative or an onset of an affricate is detected within the second time interval and if a temporal distance between a time at which the onset of the fricative or the onset of the affricate is detected and a border between the first time interval and the second time interval is smaller than a predetermined temporal distance.

5. The audio encoder according to claim 1, wherein the audio encoder is configured to perform a temporal look-ahead, such that an increased temporal resolution is used to provide bandwidth extension information for a first time interval of a given temporal length preceding a second time interval of the given temporal length in response to a detection of an onset of a fricative or of an onset of an affricate in the second time interval.

6. The audio encoder according to claim 1, wherein the audio encoder is configured to adjust a temporal resolution used by the bandwidth extension information provider such that bandwidth extension information is provided with a same increased temporal resolution at least for a predetermined period of time before a time at which an onset of a fricative or an onset of an affricate is detected and for a predetermined period of time following the time at which the onset of the fricative or the onset of the affricate is detected.

7. The audio encoder according to claim 1, wherein the audio encoder is configured to adjust a temporal resolution used by the bandwidth extension information provider such that sets of bandwidth extension information are provided with same increased temporal resolutions at least for a first time sub-interval, a second time sub-interval and a third time sub-interval, wherein the first time sub-interval immediately precedes the second time sub-interval;

wherein an onset of a fricative or an onset of an affricate is detected in the second time sub-interval; and wherein the third time sub-interval immediately follows the second time sub-interval.

8. The audio encoder according to claim 1, wherein the detector is configured to detect an offset of a fricative or affricate; and wherein the audio encoder is configured to adjust a temporal resolution used by the bandwidth extension information provider such that bandwidth extension information is provided with an increased temporal resolution at least for a predetermined period of time before a time at which an offset of a fricative or affricate is detected and for a predetermined period of time following the time at which the offset of the fricative or affricate is detected.

9. The audio encoder according to claim 1, wherein the detector is configured to evaluate a zero crossing rate, and/or an energy ratio, and/or a spectral tilt in order to detect an onset of a fricative or an onset of an affricate.

10. The audio encoder according to claim 1, wherein the detector is configured to evaluate a zero crossing rate, and/or an energy ratio, and/or a spectral tilt in order to detect an offset of a fricative or affricate.

11. The audio encoder according to claim 1, wherein the audio encoder is configured to selectively adjust a temporal resolution used by the bandwidth extension information provider such that bandwidth extension information is provided with an increased temporal resolution in response to a detection of an onset of a fricative or an onset of an affricate only for a speech signal portion but not for a music signal portion.

12. The audio encoder according to claim 1, wherein the audio encoder is configured to selectively use an increased temporal resolution to provide bandwidth extension information for a plurality of subsequent time intervals that encompass a time at which an onset of a fricative or an onset of an affricate is detected in response to a detection of an onset of a fricative or of an onset of an affricate or in response to a detection of an offset of a fricative or affricate.

13. The audio encoder according to claim 12, wherein the audio encoder is configured to selectively use an increased temporal resolution to provide bandwidth extension information for a plurality of subsequent time intervals that fully encompass an onset of a detected fricative or affricate.

14. A system, comprising:

an audio encoder according to claim 1; and an audio decoder configured to receive the encoded audio information provided by the audio encoder, and to provide, on the basis thereof, a decoded audio information, wherein the audio decoder is configured to perform a bandwidth extension on the basis of the bandwidth extension information provided by the audio encoder, such that the bandwidth extension is performed with an increased temporal resolution at least for a predetermined period of time before a time at which an onset of a fricative or an onset of an affricate is detected and for a predetermined period of time following the time at which the onset of the fricative or the onset of the affricate is detected, or such that the bandwidth extension is performed with an increased temporal resolution at least for a predetermined period of time before a time at which an offset of a fricative or affricate is detected and for a predetermined period of time following the time at which the offset of the fricative or affricate is detected.

15. A method for providing an encoded audio information on the basis of an input audio information, the method comprising:

providing bandwidth extension information using a variable temporal resolution; and detecting an onset of a fricative or an onset of an affricate;

wherein a temporal resolution used for providing the bandwidth extension information is adjusted such that bandwidth extension information is provided with an increased temporal resolution at least for a predetermined period of time before a time at which an onset of a fricative or an onset of an affricate is detected and for a predetermined period of time following the time at which the onset of the fricative or the onset of the affricate is detected;

wherein the bandwidth extension information is provided such that the bandwidth extension information is associated with temporally regular time intervals of equal temporal lengths, wherein a single set of bandwidth extension information is provided for a time interval of a given temporal length if a first temporal resolution is used, and wherein a plurality of sets of bandwidth extension information associated with time sub-intervals is provided for a time interval of the given temporal length if a second temporal resolution is used;

wherein a temporal resolution used is adjusted such that at least one time sub-interval, to which a set of bandwidth extension information is associated, immediately precedes another time sub-interval during which an onset of a fricative or an onset of an affricate is detected, such that in at least the one time sub-interval, which precedes the another time sub-interval in which an onset of a fricative or an onset of an affricate is detected, the increased temporal resolution is used, wherein another set of bandwidth extension information is associated to the another time sub-interval.

16. A non-transitory digital storage medium having stored thereon a computer program for performing a method according to claim 15 when the computer program runs on a computer.

* * * * *